US006998995B2

(12) United States Patent
Nakajima

(10) Patent No.: US 6,998,995 B2
(45) Date of Patent: Feb. 14, 2006

(54) ELEVATOR REMOTE MONITORING APPARATUS

(75) Inventor: Yutaka Nakajima, Saitama-ken (JP)

(73) Assignee: Toshiba Elevator Kabushiki Kaisha, Tokyo-To (JP)

( * ) Notice: Subject to any disclaimer, the term of this patent is extended or adjusted under 35 U.S.C. 154(b) by 124 days.

(21) Appl. No.: 10/489,608

(22) PCT Filed: Sep. 27, 2002

(86) PCT No.: PCT/JP02/10078

§ 371 (c)(1),
(2), (4) Date: Mar. 22, 2004

(87) PCT Pub. No.: WO03/029122

PCT Pub. Date: Apr. 10, 2003

(65) Prior Publication Data

US 2004/0240627 A1 Dec. 2, 2004

(30) Foreign Application Priority Data

Sep. 28, 2001 (JP) ..... 2001-300574
Sep. 28, 2001 (JP) ..... 2001-300732

(51) Int. Cl.
*G08B 21/00* (2006.01)

(52) U.S. Cl. ..... 340/686.1; 340/693.1; 340/693.2; 340/3.1; 379/39

(58) Field of Classification Search ..... 340/693.1, 340/693.2, 693.3, 693.4, 3.1, 286.01, 506, 340/533, 686.1; 379/37, 39, 40
See application file for complete search history.

(56) References Cited

U.S. PATENT DOCUMENTS 5,445,245 A * 8/1995 Ketoviita ..... 187/391

(Continued)

FOREIGN PATENT DOCUMENTS

JP 6-5333 2/1994

(Continued)

*Primary Examiner*—Daryl C Pope
(74) *Attorney, Agent, or Firm*—Oblon, Spivak, McClelland, Maier & Neustadt, P.C.

(57) ABSTRACT

A remote monitoring system for elevator has a plurality of remote monitors for individually monitoring the running states of a plurality of elevators installed in a building, transmits running state data from the remote monitoring system via a communal public telephone line to a communal monitoring center, and allows communication between interphones, provided in the carriages of the elevators, and the monitoring center via the public telephone line. Each of the plurality of remote monitors comprises a memory unit which stores incoming time data of different incoming times, the remote monitor performing incoming controls after independently determining call signals from the monitoring center, based on the incoming time data stored in the memory unit. Furthermore, a first switching unit cuts off the auxiliary power when there has been no irregularity in the monitoring information of the elevator after the operating power has been supplied for a fixed period of time from an auxiliary power instead of the main power when the main power fails; and a second switching unit is driven by power from an interphone battery, and re-injects the auxiliary power when an emergency call button has been pressed.

21 Claims, 23 Drawing Sheets

U.S. PATENT DOCUMENTS 5,714,726 A * 2/1998 Ketoviita ..... 187/391
5,736,694 A * 4/1998 Ketoviita ..... 187/391
6,073,727 A * 6/2000 DiFranza et al. ..... 187/396
6,147,620 A * 11/2000 Remmers et al. ..... 340/815.42
6,460,658 B1 * 10/2002 Suga et al. ..... 187/290
2004/0035646 A1 * 2/2004 Araki ..... 187/290

FOREIGN PATENT DOCUMENTS

JP 6-71291 9/1994
JP 11-11815 1/1999
JP 2883772 2/1999

* cited by examiner

ELEVATOR REMOTE MONITORING APPARATUS

BACKGROUND OF THE INVENTION

1. Field of the Invention

The present invention relates to a remote monitor for elevator. More particularly, this invention relates to the remote monitor for elevator comprising an auxiliary power, which supplies operating power instead of main power when the main power fails, an interphone battery for an interphone provided inside the elevator carriage, a unit which monitors the running status of the elevator and transmits the running status via a public telephone line network to a monitoring center of an elevator maintenance company, and a unit which allows communication between the interphone and the monitoring center by switching ON an emergency call button provided inside the elevator carriage.

This invention further relates to a remote monitoring system for elevator having a plurality of remote monitors for elevator, which individually monitor the running statuses of a plurality of elevators provided in a building, the remote monitor system transmitting running status data from the remote monitors via a communal public telephone line to a communal monitoring center, and allowing communication between interphones provided in the elevator carriages and the monitoring center via the public telephone line.

2. Description of the Related Art

Elevators are provided in medium and high-rise buildings, as well as in smaller-scale buildings and private homes, as means for vertical transportation within the building. Elevators for conveying persons and goods must run safely at all times, and, to this end, they are maintained and checked constantly by special maintenance personnel.

An elevator is usually maintained by special maintenance personnel of an elevator maintenance company, but it has recently become possible to monitor the running status of an elevator 24 hours a day, 365 days a year, by using a remote monitoring system via a public telephone line. The running status of the elevator is remotely monitored by the remote monitoring system, and the maintenance personnel visits the site of the elevator only for routine inspections and when there appears to be a danger of an irregularity.

This remote monitoring system constantly monitors the running status of the elevator provided in a building by using a remote monitor, provided in the same building, and transmits various types of collected data along a public network to the monitoring center of an elevator maintenance company. An interphone for emergencies is provided inside the elevator carriage, and passengers can communicate with the staff of the monitoring center of the elevator maintenance company via the interphone and the remote monitor when the elevator stops due to power failure, or when the passengers are stuck inside the elevator carriage.

Data transmitted from a great number of elevators is monitored at the monitoring center, and, when there are signs of irregularity or an accident has been confirmed, the maintenance personnel hurry to the site to confirm and deal with the irregularity.

FIG. 21 shows the schematic constitution of a conventional remote monitoring system of this type. In the remote monitoring system of FIG. 21, a remote monitor. 2 for collecting status data needed in monitoring the elevator, and an elevator controller 4 for controlling the movement of an elevator carriage 3 (up, down, stop, etc.) are provided inside an elevator machine chamber 1. The remote monitor 2 and the elevator controller 4 are connected by a transmission line

5. An interphone 6 and an emergency call button 6A for emergencies are provided in the elevator carriage 3. The elevator controller 4 and the elevator carriage 3 are electrically connected by a tail code 7, and the communications path of the interphone 6 is connected by the tail code 7 to the elevator machine chamber 1.

When an irregularity occurs in the operation of the elevator, a passenger 3A switches ON the emergency call button 6A, provided on the control panel of the elevator carriage, making it possible for the communications path to carry communications from the elevator machine chamber 1 to a mother interphone, provided in the room of a building maintenance officer.

The interphone 6 is an emergency communications device, and, for this reason, an interphone battery 26 is provided in the elevator machine chamber 1 so that the interphone 6 can be used in the event of elevator power failure. A Ni—Cd battery of DC 6V or DC 24V is, for example, used as the interphone battery 26.

The interphone 6 is usually operated by electrical power from the elevator machine chamber 1; when the power fails, the interphone battery 26 guarantees the interphone 6 an operating time of up to approximately thirty minutes.

The various types of data collected by the remote monitor 2 are transmitted via a public telephone line network 8 and a telephone station 8A to a receiver in the monitoring center of an elevator maintenance company 9. The data are stored in data bases for each client, kept at the elevator maintenance company 9. When the data has been transmitted from the remote monitor 2 to the elevator maintenance company 9, information relating to the corresponding building and elevator is immediately displayed on a display at the elevator maintenance company 9.

The remote monitor 2 has three main functions.

The first function of the remote monitor 2 is to enable the passenger 3A to communicate with the monitoring center operator of the elevator maintenance company 9 when the passenger 3A has become trapped in the elevator carriage 3 as a result of accident, power failure, or the like; this eases the anxiety of the passenger 3A and enables him to be rescued rapidly.

The maintenance officer in the building can be contacted by pressing the emergency call button 6A in the elevator carriage 3, but since the interphone 6 allows direct communication with the elevator maintenance company 9 when there is an accident or a power failure, it performs an important role in enabling the passenger 3A to inform the staff at the elevator maintenance company 9 of the circumstances of the accident and the situation of the passengers and to appeal for assistance, and to enable to the elevator maintenance company 9 to calmly inform the passengers 3A of the progress of the rescue, and such like.

The second function of the remote monitor 2 is safety prevention prior to the occurrence of irregularities. The remote monitor 2 constantly receives data relating to the running status of the elevator from the elevator controller 4 via the transmission line 5, and transmits the running status data along the public telephone line network 8 to the elevator maintenance company 9. The elevator maintenance company 9 can identify potential irregularities from changes in the received data, and carry out inspections and overhauls accordingly to prevent accidents, power failures, and the like.

The third function of the remote monitor 2 is to shorten the repair time in the event of an accident. Since data relating to the running status of the elevator is constantly transmitted to the elevator maintenance company 9, the status at the time of an accident can be precisely determined at the elevator maintenance company 9, making it possible to speedily implement countermeasures in a short space of time. As a result, the repair time of the elevator can be shortened.

FIG. 22 is a block line diagram showing the schematic internal constitution of the remote monitor 2. The remote monitor 2 comprises a digital circuit 10 which receives, processes, and stores data from the elevator controller 4 and the elevator maintenance company 9, a telephone line processor 11 which controls transmissions with the public telephone line network 8, a data transmitter 12 which processes data transmissions with the elevator controller 4 and the elevator maintenance company 9, a sound processor 13 which sound-processes transmissions with the interphone 6 provided in the elevator carriage 3 and the public telephone line network 8, and a power section 27 which supplies operating power to the various sections.

The constitution of the digital circuit 10 centers around a CPU 14 of approximately sixteen bits, and also comprises a read-only memory (ROM) 15 for storing programs for the CPU 14, a read/write memory (RAM) 16 for storing data, an electrically deletable ROM (EEROM) 17 for storing used data, a calendar IC for time control 18 for internally generating dates and times, and a digital input/output circuit 33 for processing the I/O of digital data.

A telephone line processor 11 comprises an in-use determining circuit 19 which determines the use status of the public telephone line network 8, a ringing circuit 20 which determines a call sound of a telephone line, a dial circuit 21 for dial transmission, a tone circuit 22 which receives and transmits a push-button signal (PB), and the like, and generally has the same overall constitution as a telephone and a modem. A data transmitter 12 comprises a serial circuit 23 which exchanges data with the elevator controller 4 via a transmission line 5, and a data converter 24 which converts the data so that a connection can be made to the elevator controller 4. A sound processor 13 comprises an amplifier which performs sound matching between the interphone in the elevator carriage 3 and the public telephone line network 8. A power section 27 converts the voltage of a main power (e.g. a dc power circuit which transforms, rectifies, and smoothes, a commercial power voltage) to a dc current suitable for various electronic circuits (e.g. DC 5V), and comprises a main power section 28, and an auxiliary power 29 which guarantees operation of the CPU 14 and the like when the main power fails.

FIG. 23 is a block line diagram showing the internal constitution of the power section 27. The main power section 28 comprises a switching power 28A, and the auxiliary power 29 comprises a battery 29A. The switching power 28A converts the main power voltage to approximately DC 7.2 V (point A), and the battery 29A is charges via a charging resistance 31. The battery 29A is, for example, an Ni—Cd (nickel—cadmium) battery, and comprises six nominal DC 1.2 unit batteries connected in series, resulting in a dc power of DC 7.2 V. The maximum dc current flowing via the charging resistance 31 to the battery 29A is approximately 10 to 20 mA, and the battery 29A is always in a charged state when the main power is being supplied. The output voltage of the switching power 28A passes a DC/DC converter 32 and generates a voltage of DC 5V at the output terminal (point B). Since a voltage of approximately DC 5V is needed to operate electronic circuits such as microcomputers, the DC/DC converter 32 converts the voltage at point A to DC 5V (point B).

When the main power fails, a dc voltage is supplied from the battery 29A to the DC/DC converter 32 via a diode 30, which splits the charging resistance 31, supplying emergency power instead of the main power for a predetermined period, e.g. approximately thirty minutes. This type of charge power constitution is termed "trickle charging", and is widely used as emergency power.

FIG. 24 is a timing chart for operation during main power failure. When the main power fails, uninterrupted power is supplied from the battery 29A to the point A, enabling the remote monitor to continuously operate as normal. The battery 29A can only continue to supply power for approximately thirty minutes, but there is usually no danger of breakdown, since most power failures last for limited periods of times.

Conventionally, since the battery 29A continues to supply power in the power section 27 of the remote monitor 2 during power failure, in regions where power failures occur frequently, the battery 29A is prematurely exhausted, resulting in a problem the capacity of the battery 29A must be increased to avoid battery exhaustion.

On the other hand, when a plurality of elevators are provided in a single building, the reliability of communications becomes problematic.

In recent years, there are more and more buildings containing a plurality of elevators. In such cases, the remote monitors 2 for the elevators usually share the communal public telephone line 8 in order to reduce costs.

FIG. 25 shows a constitution of this type. In FIG. 25, three remote monitors 2A, 2B, and 2C are provided to monitor three elevators. The remote monitors 2A, 2B, and 2C are provided in correspondence with elevator controllers 4A, 4B, and 4C of each elevator, and share the public telephone line 8. The public telephone line 8 connects to a first remote monitor 2A, but a line/phone terminal (not illustrated in FIG. 25, this is generally used in a conventional modem to connect the modem to the telephone) of the internal telephone line processor 11 is independent, and the public telephone line 8 connects to the line terminal of the telephone line processor 11.

The public telephone line 8 is shared communally by the remote monitors, a telephone line 44 connecting the phone terminal of the remote monitor 2A to the line terminal of the remote monitor 2B, and similarly, a telephone line 45 connecting the phone terminal of the remote monitor 2B to the line terminal of the remote monitor 2C.

According to this constitution, one public telephone line 8 can be shared communally by the remote monitors 2A, 2B, and 2C. Since there is little possibility of transmissions being sent to the monitoring center 38 simultaneously from a plurality of remote monitors, a communal arrangement of this type achieves a problem-free system.

However, since it is not possible to select a specific remote monitor 2 in response to a call from the monitoring center 38 to the remote monitors, various methods have been proposed to solve this drawback.

For example, Japanese Examined Patent Publication No. 6-71291 discloses a method for transmitting data from the monitoring center 38 side of an elevator maintenance company 9 to a plurality of remote monitors 2, which share a communal public telephone line 8, wherein an incoming communication sequence is allocated beforehand to the remote monitors 2, and a desired remote monitor 2 is selected from the plurality of remote monitors sharing the communal public telephone line 8 by using an incoming communication stop setting unit, which stops the incoming communication of the remote monitor 2 from the monitoring center 38 side.

According to this method, in accessing a low-ranking sequence remote monitor among the plurality of remote monitors sharing the communal public telephone line 8 from the monitoring center 38, communication to the remote monitors of higher sequence than the selected one is sequentially stopped, preventing them from receiving communications for a predetermined period of time, then transmission is recommenced and the first communication is sent to the desired low-sequence remote monitor. In this case, when the sequential ranking of the desired remote monitor is low, communication to all the monitors above it must be stopped one by one.

Japanese Unexamined Patent Publication No. 11-232570 proposes an improvement which enables incoming communications to be stopped in two operations or less, by adding a local communication function between the remote monitors 2 and appending the number of the remote monitor 2 desired by the monitoring center 38 at the time of the first communication.

Japanese Unexamined Patent Publication No. 11-1815 proposes a further improvement which makes it possible to give priority to a broken-down remote monitor 2 in transmitting a communication.

Elevator breakdowns range from light malfunctions of little urgency to serious accidents requiring urgent attention. In particular, breakdowns which leave passengers trapped inside the elevator carriage are to be regarded as extremely serious emergencies.

When a breakdown occurs, a passenger 36 inside the elevator carriage 3 presses an emergency call button 34 to notify the monitoring center 38 of the elevator maintenance company 9. This enables normal countermeasures to be carried out.

However, when the passenger 36 inside the elevator carriage 3 wishes to obtain additional information from the staff at the monitoring center 38, a transmission must be sent from the monitoring center 38 to the elevator carriage 3. When this type of situation occurs simultaneously among a plurality of remote monitors 2 sharing the communal public telephone line 8, there is a drawback that time is wasted in making a telephone transmission from the monitoring center 38 of the elevator maintenance company 9 to the remote monitor 2 responsible for that el.

Although the method of providing a local communication function between the plurality of remote monitors 2 solves the problem mentioned above, it has a drawback that there are difficulties in ensuring reliability of the communications between the plurality of remote monitors 2A, 2B, and 2C.

SUMMARY OF THE INVENTION

It is a first object of this invention to provide a remote monitor for elevator which can fulfill safety functions with a low-capacity battery, without becoming prematurely exhausted during a power failure.

It is a second object of this invention to provide a remote monitoring system which, when a plurality of remote monitors are sharing a public telephone line, enables a desired model (i.e. a desired remote monitor) to be selected in response to a call from a monitoring center.

To achieve the first object, this invention provides a remote monitoring system for elevator having a plurality of remote monitors for individually monitoring the running states of a plurality of elevators installed in a building, the remote monitoring system transmitting running state data from the remote monitoring system via a communal public telephone line to a communal monitoring center, and allowing communication between interphones, provided in the carriages of the elevators, and the monitoring center via the public telephone line. Each of the plurality of remote monitors comprises a memory unit which stores incoming time data of different incoming times, the remote monitor performing incoming controls after independently determining call signals from the monitoring center, based on the incoming time data stored in the memory unit.

To achieve the second object, this invention provides a remote monitor for elevator comprising an auxiliary power which supplies operating power instead of a main power when the main power fails; an interphone battery for an interphone, provided in an elevator carriage; a transmitting unit which monitors the running state of the elevator and transmits the running state to a monitoring center of an elevator maintenance agency via a public telephone line network; a communication unit which allows communication between the interphone and the monitoring center by switching ON an emergency call button, provided in the elevator carriage; a first switching unit which cuts off the auxiliary power when there has been no irregularity in the monitoring information of the elevator after the operating power has been supplied for a fixed period of time from the auxiliary power instead of the main power when the main power fails; and a second switching unit which is driven by power from the interphone battery, and re-injects the auxiliary power when the emergency call button has been pressed.

PREFERRED EMBODIMENTS

Embodiments of the present invention will be explained with reference to the drawings.

Embodiment 1

Figure 1:
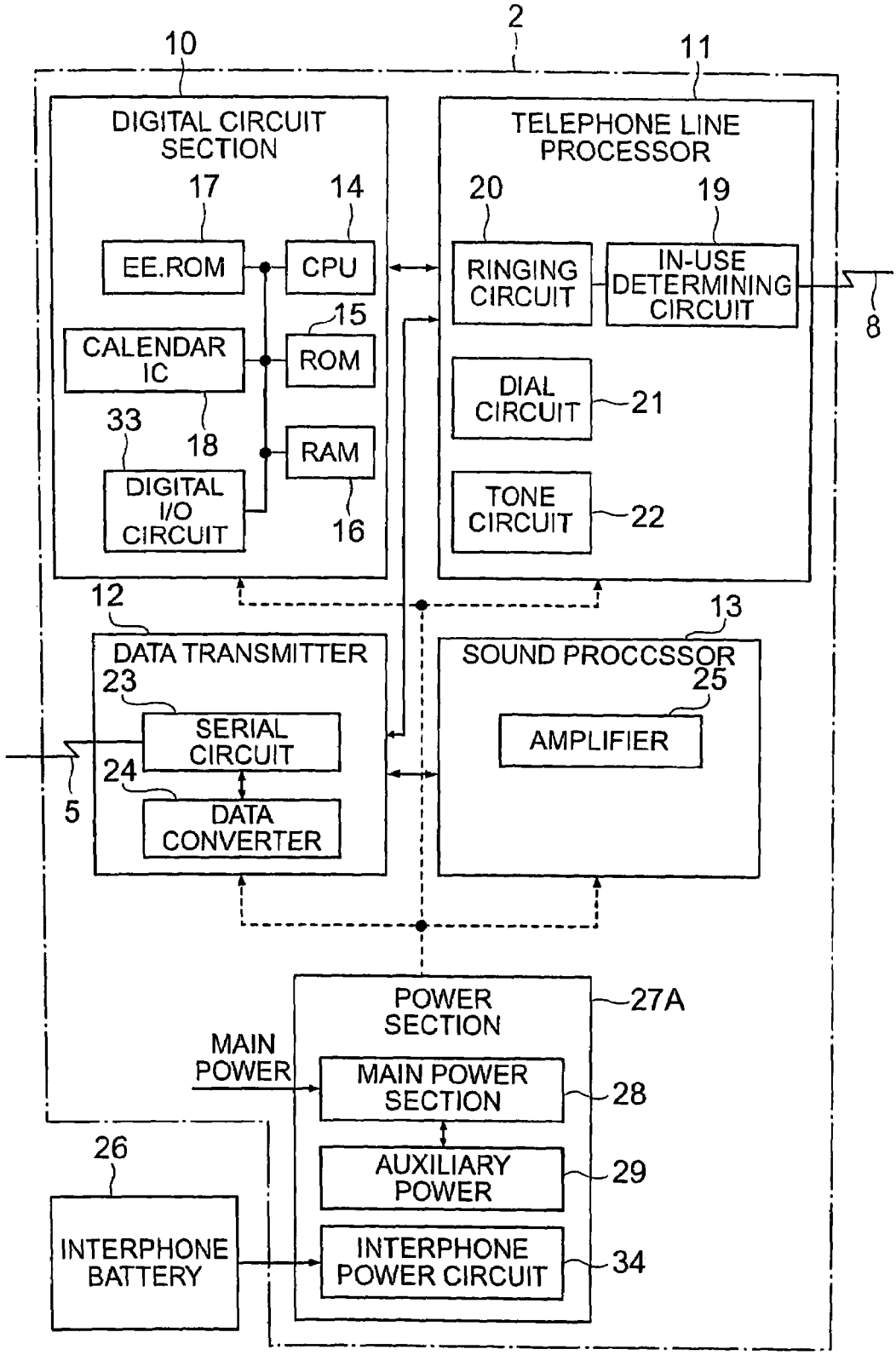
FIG. 1 is a block line diagram showing a first embodiment of the remote monitor according to this invention.
Figure 2:
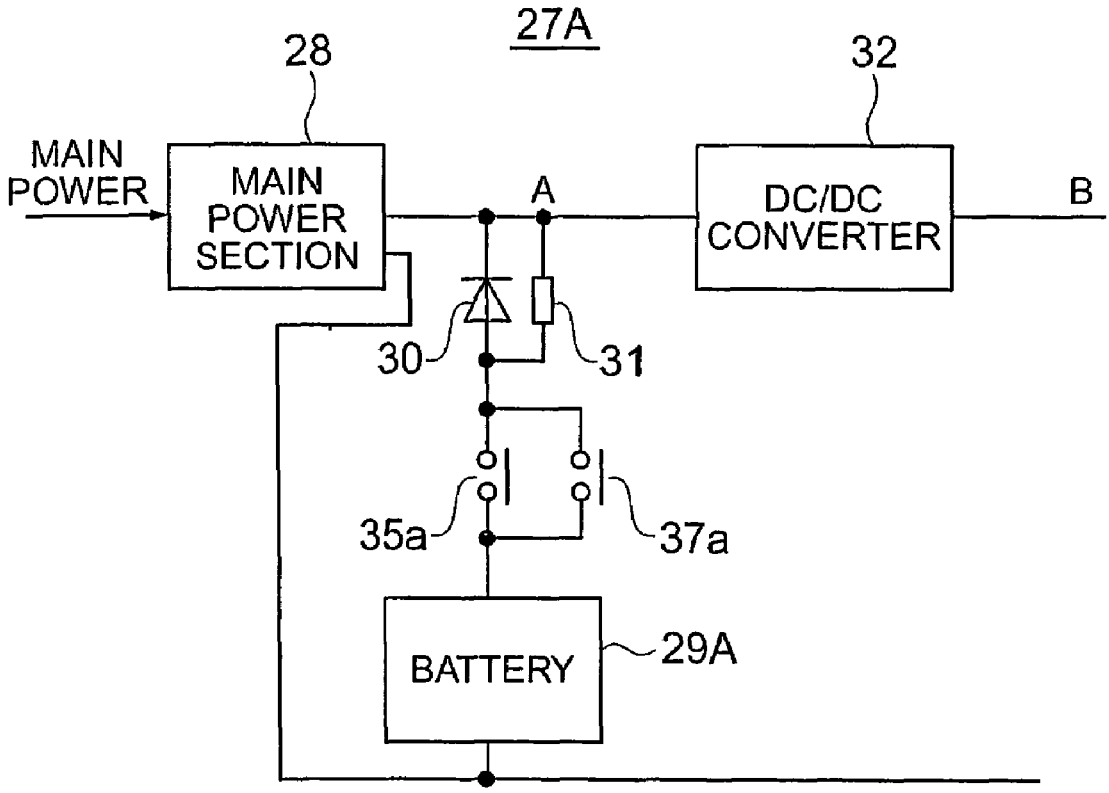
FIG. 2 is a block line diagram of a power section in the remote monitor of FIG. 1.
Figure 3:
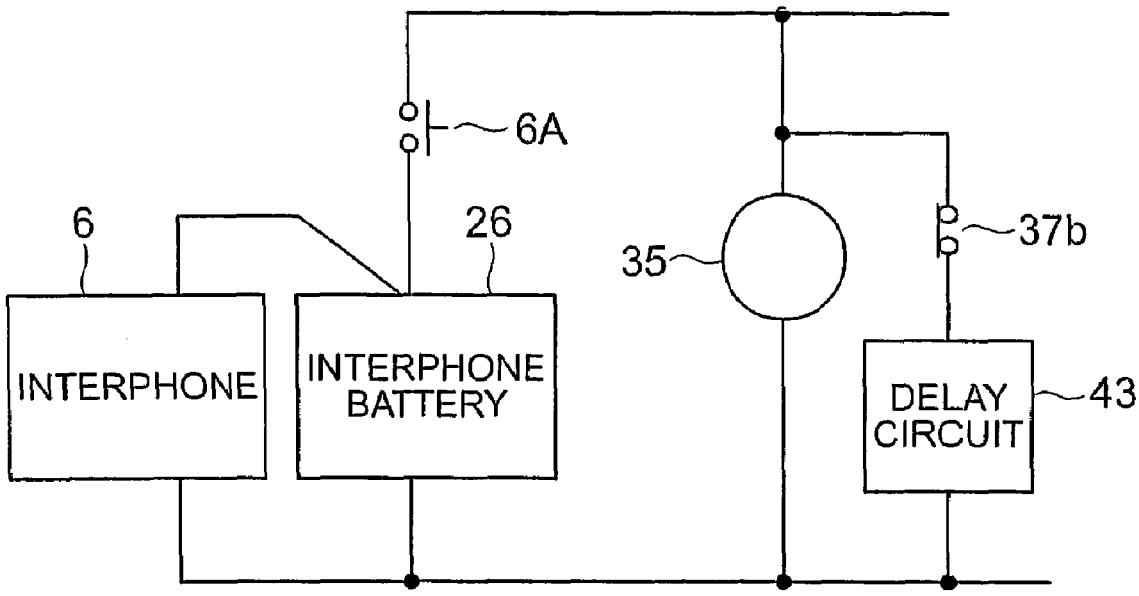
FIG. 3 is a block line diagram of an interphone power section in the remote monitor of FIG. 1.
Figure 4:
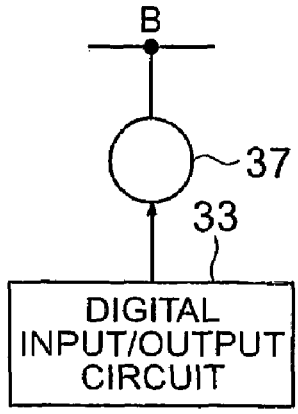
FIG. 4 is an additional block line diagram of a digital circuit section in the remote monitor of FIG. 1.

FIG. 1 is a block line diagram showing a first embodiment of the remote monitor according to this invention, FIG. 2 is a block line diagram of a power section in the remote monitor of FIG. 1, FIG. 3 is a block line diagram of an interphone power section in the remote monitor of FIG. 1, and FIG. 4 is an additional block line diagram of a digital circuit section in the remote monitor of FIG. 1.

Figure 14:
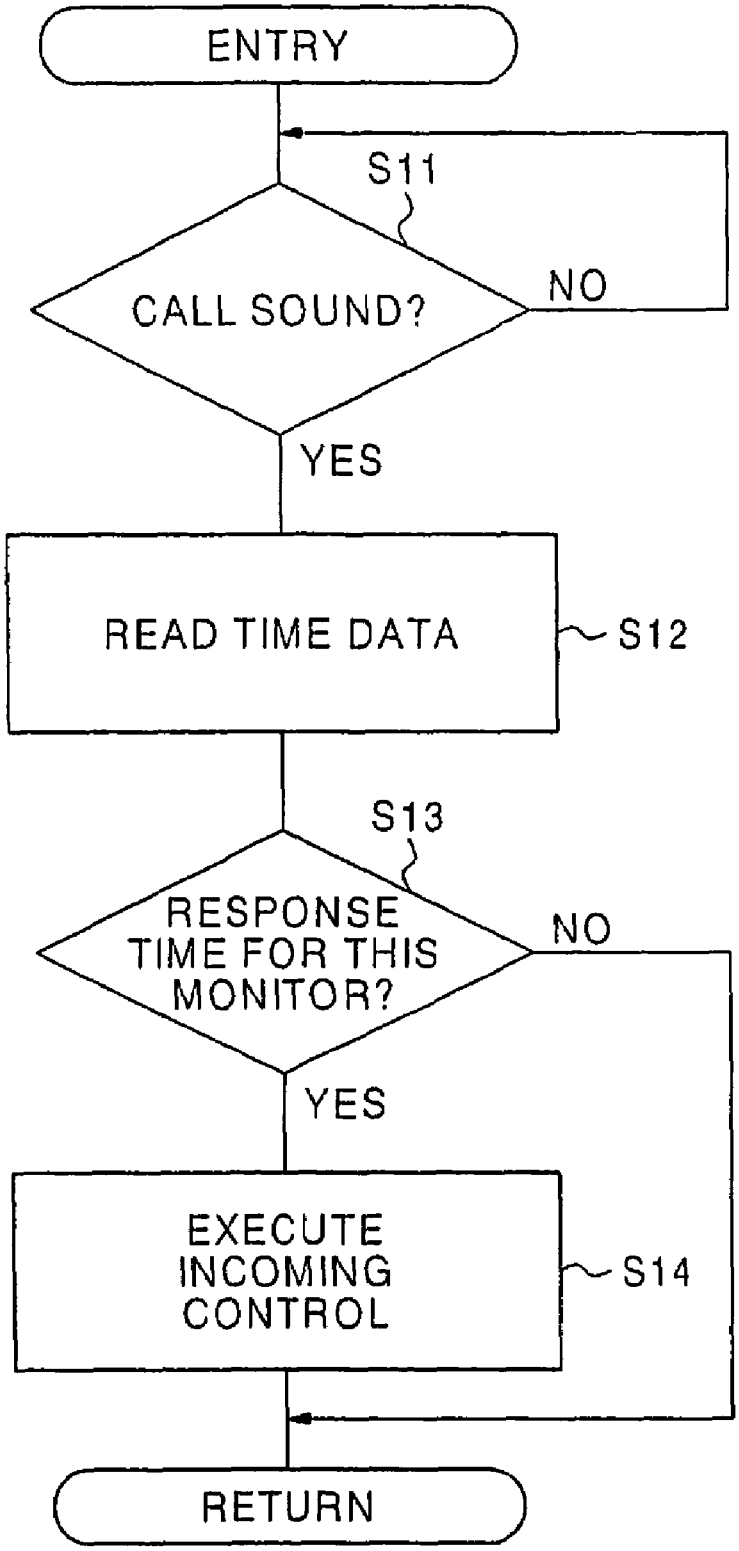
FIG. 14 is a flowchart illustrating the operation of an incoming-call controller in the remote monitor for elevator according to the ninth embodiment.

The remote monitor 2 of FIG. 1 has basically the same constitution as the remote monitor 2 of FIG. 14, and same parts are represented by the same reference models. In order to control the load circuit of the interphone battery 26, the remote monitor 2 of FIG. 1 comprises a power section 27A having an interphone power circuit 34. The other parts are the same as those in the remote monitor of FIG. 14.

As shown in FIG. 2, in the power section 27A, a parallel circuit of relay contacts 35*a* and 37*a* is connected in series to an auxiliary power 29 comprising a battery 29A, and electrical power is supplied from the battery 29A (battery 29A discharge) with the condition that at least one of the relay contacts 35*a* and 37*a* is ON. This example uses an electromagnetic relay as a switching unit, and the relay contacts are shown as open/close contacts of the electromagnetic relay.

As shown in FIG. 3, when the emergency call button 6A (see FIG. 13) in the elevator carriage 3 is switched ON, the contact 35*a* becomes an always-open contact of an electromagnetic relay 35 applied by the interphone battery 26 only during ON. A delay circuit 43 is connected in parallel to the electromagnetic relay 35 via an always-closed contact 37*b*. An electromagnetic relay 37 comprises a first switching unit, and the electromagnetic relay 35 comprises a second switching unit. The constitution and functions of the delay circuit 43 will be explained later as a second embodiment.

The interphone 6 is operated by electrical power supplied from the interphone battery 26. As shown in FIG. 4, the relay contact 37*a* is an always-open contact of the electromagnetic relay 37, applied with the condition that a voltage is generated at the output terminal B (see FIG. 2) of the power section 27A by a signal from a digital input/output circuit 33 of the digital circuit 10 of the remote monitor 2. The electromagnetic relay 37 is switched OFF via the digital input/output circuit 33 in order to cut off the auxiliary power 29, i.e. the battery 29A, after a fixed period of time (e.g. ten minutes) has elapsed without change in the monitor information after the main power has failed.

During normal operation without power failure, the remote monitor 2 is operated by main power via the elevator controller 4. In the power section 27A, the electromagnetic relay 37 becomes operative and a main power section 28 recharges the battery 29A via the relay contact 37*a*; in addition, a DC 6V is output at the output terminal B via a DC/DC converter 32.

When the main power fails, the electrical power supply from the battery 29A to the output terminal B continues without interruption via the relay contact 37*a* and a diode 30, enabling the a2 to continue operating as if there had been no power failure.

When an accident signal is not transmitted from the elevator controller 4 in a fixed period of time after power failure, the electromagnetic relay 37 is switched OFF by a signal from a digital circuit section 10A and the relay contact 37*a* switches OFF, cutting off the battery 29A and terminating the function of the remote monitor 2. Consequently, exhaustion of the auxiliary power 29 can be avoided.

With the relay contact 37*a* switched OFF and the battery 29A cut off during power failure, when a passenger 3A presses the emergency call button 6A inside the elevator carriage 3, the interphone battery 26 drives the electromagnetic relay 35, so that power is once again supplied from the battery 29A via the relay contact 35*a*, the diode 30, and the DC/DC converter 32, to the point B of the remote monitor 2, reactivating the remote monitor 2.

Figure 5:
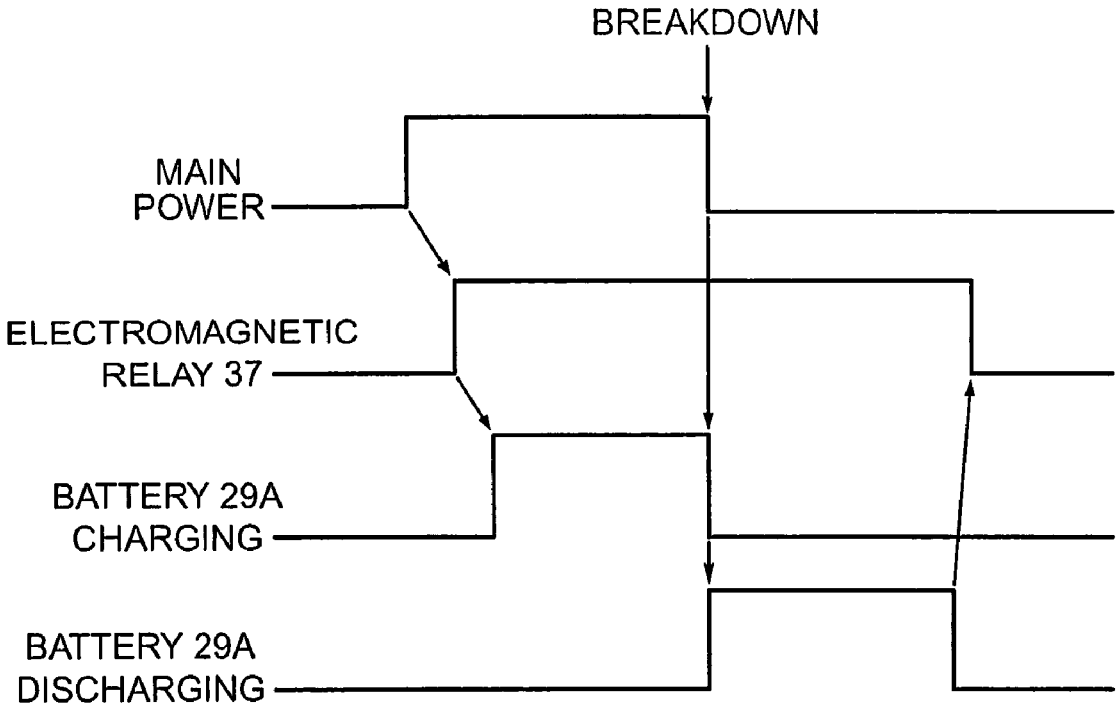
FIG. 5 is a timing chart illustrating the operation at the time of power failure in the remote monitor of FIG. 1.

FIG. 5 is a timing chart illustrating the operation when the main power fails as described above. When the main power is working normally, the electromagnetic relay 37 is applied via the digital input/output circuit 33 in compliance with a command from a CPU 14. As a result, the relay contact 37*a* of FIG. 2 closes and the battery 29A is charged via the main power section 28; in addition, a voltage is generated at the point B via the DC/DC converter 32, allowing the remote monitor 2 to operate normally.

When the main power fails, the battery 29A switches from recharging to discharging. Since this switch is performed without interruption, the CPU 14 continues operating without a break. Therefore, the electromagnetic relay 37 remains ON. However, unless there is a subsequent elevator irregularity, the CPU 14 switches the electromagnetic relay 37 OFF for a period of time stored in an EEROM 17 (e.g. ten minutes), and terminates the operation of the remote monitor 2.

Figure 6:
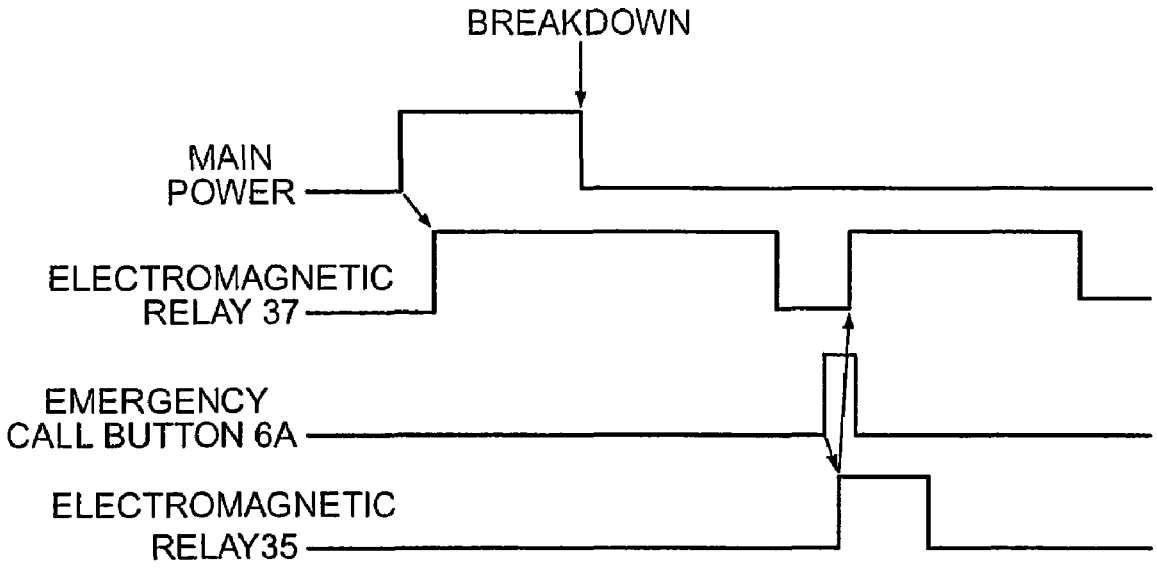
FIG. 6 is a timing chart illustrating the operation when an emergency call button is pressed in the remote monitor of FIG. 1.

FIG. 6 is a timing chart illustrating the operation when the emergency call button 6A has been pressed during main power failure. The operations from power failure until the electromagnetic relay 37 switches OFF are the same as in FIG. 5. When the emergency call button 6A is pressed, the interphone battery 26 applies the electromagnetic relay 35 and the relay contact 35*a* switches ON, whereby power is once again supplied from the battery 29A via the diode 30 to the point B.

This enables the CPU 14 to operate. Thereafter, as when power is being supplied normally, the electromagnetic relay 37 switches ON and power can be supplied continuously from the battery 29A via the relay contact 37*a*. Therefore, the same operations can be performed as in normal operating status, even when the emergency call button 6A is OFF.

Figure 7:
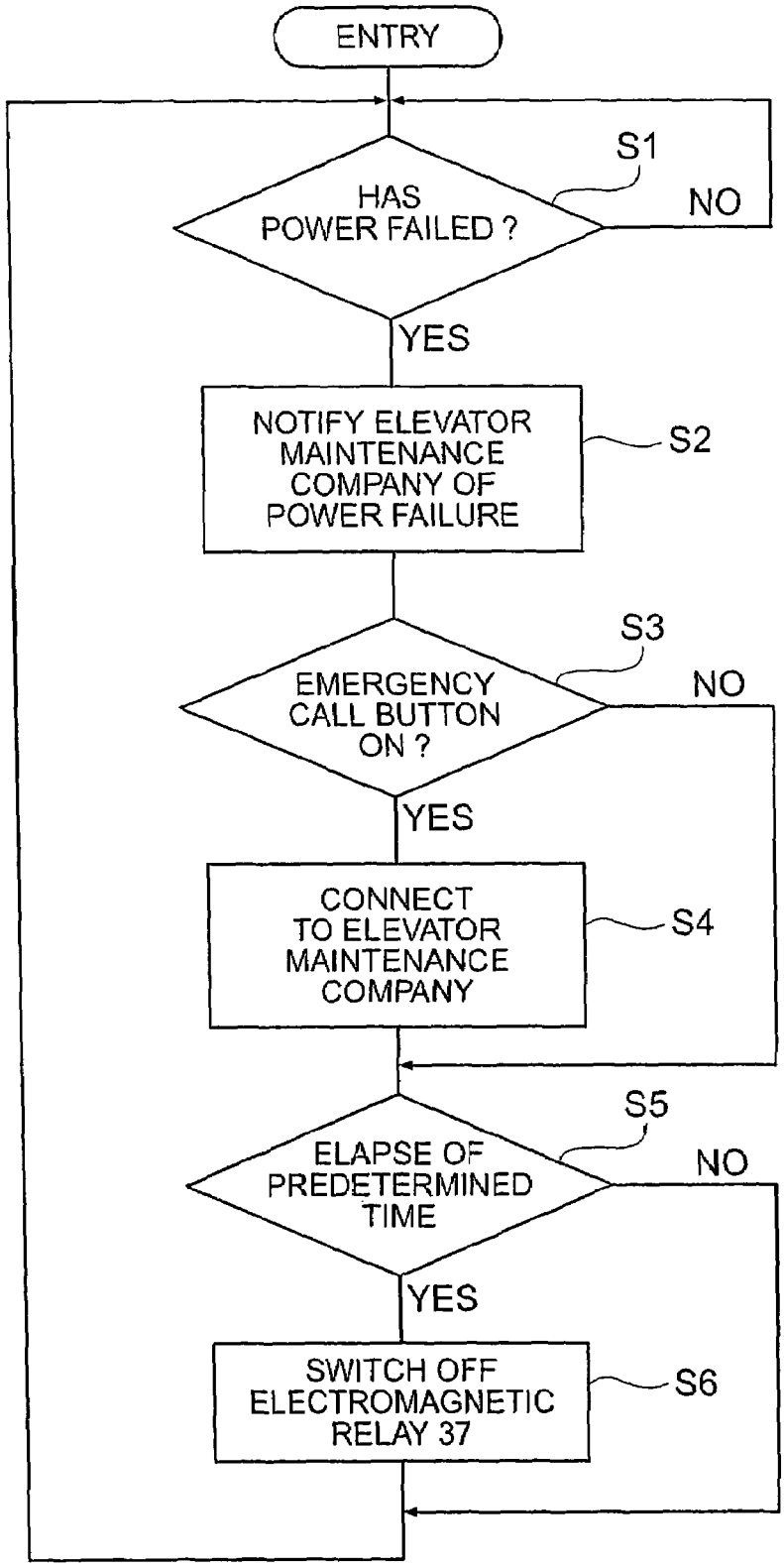
FIG. 7 is a flow chart illustrating the operation of the remote monitor of FIG. 1.

FIG. 7 is a flowchart illustrating an operation of the remote monitor 2 centering on the CPU 14 of FIG. 1. In step S1, there is constant monitoring to detect power failure. This can be achieved by detecting the voltage value of the power section 27A at the digital circuit 10. When there is a power failure as described above, the continuous supply of operating power from the battery 29A enables the CPU 14 to continue operating. Therefore, power failure can be detected by notifying the CPU 14 of a drop in the voltage of the main power.

When a power failure is detected in step S1, the elevator maintenance company 9 is notified of the power failure in step S2. This is a normal function of conventional remote monitors. In step S3, the ON/OFF status of the emergency call button 6A is monitored, and, since there is no reason to waste the battery 29A when the emergency call button 6A is OFF, or when there are no passengers 3A in the elevator carriage 3 and consequently there is no possibility of the emergency call button 6A being switched ON, step S4 is skipped and the operation shifts to step S5.

When the emergency call button 6A is ON (has been switched ON) in step S3, the operation shifts to step S4. In step S4, a communications connection is made between the interphone 6 in the elevator carriage 3 and the elevator maintenance company 9, allowing both sides to communicate with each other. At this point, the passenger 3A can speak with the staff at the monitoring center of the elevator maintenance company 9 in the same manner as using a normal telephone. There are time restrictions and the like on the permissible duration of this communication, but communication can be realized by using a push-button signal in compliance with the commands of the staff at the monitoring center.

In step S5, the time period of continuous power failure is determined. The CPU 14 reads time data, stored in the EEROM 17 in the digital circuit 10, and the operation shifts to step S6 when a fixed period of time (e.g. ten minutes) has been exceeded since the start of the power failure; then, the electromagnetic relay 37 is forcibly switched OFF via the digital input/output circuit 33, switching the relay contact 37*a* OFF and ending the back-up by the battery 29A.

According to the embodiment described above, consumption of the auxiliary power 29 and the battery 29A can be minimized with due consideration for the safety of the passenger 3A.

Embodiment 2

A second embodiment relates to the delay circuit 43 in FIG. 3. The delay circuit 43 comprises, for example, a combination of C and R (capacitors and resistances), which are, for example, connected in a series circuit. The delay circuit 43 is charged by the interphone battery 26 while the emergency call button 6A is pressed ON, with the condition that the electromagnetic relay 37 is not operating.

Therefore, even when the electromagnetic relay 37 is in a non-operative state in compliance with a signal from the digital input/output circuit 33 and the emergency call button 6A has been switched OFF, the electromagnetic relay 35 is applied for a predetermined period of time via the relay contact 37*b* using the delay circuit 43 as the power source, thereby achieving the same state as when the emergency call button 6A was pressed, enabling the contact 35*a* to be closed. The power supply state when the contact 35*a* is closed has already been described.

As a result of this supply of power, when the CPU 14 becomes active and the electromagnetic relay 37 is switched ON by a signal from the digital input/output circuit 33, the always-closed contact 37*b* switches the delay circuit 43 OFF and the supply of power via the relay contact 37*a* can continue. As already mentioned, power is supplied by the battery 29A only for a predetermined period of time.

In this way, this embodiment prevents the supply of power from being cut off as a result of delay in the operation of the CPU 14.

Embodiment 3

Figure 8:
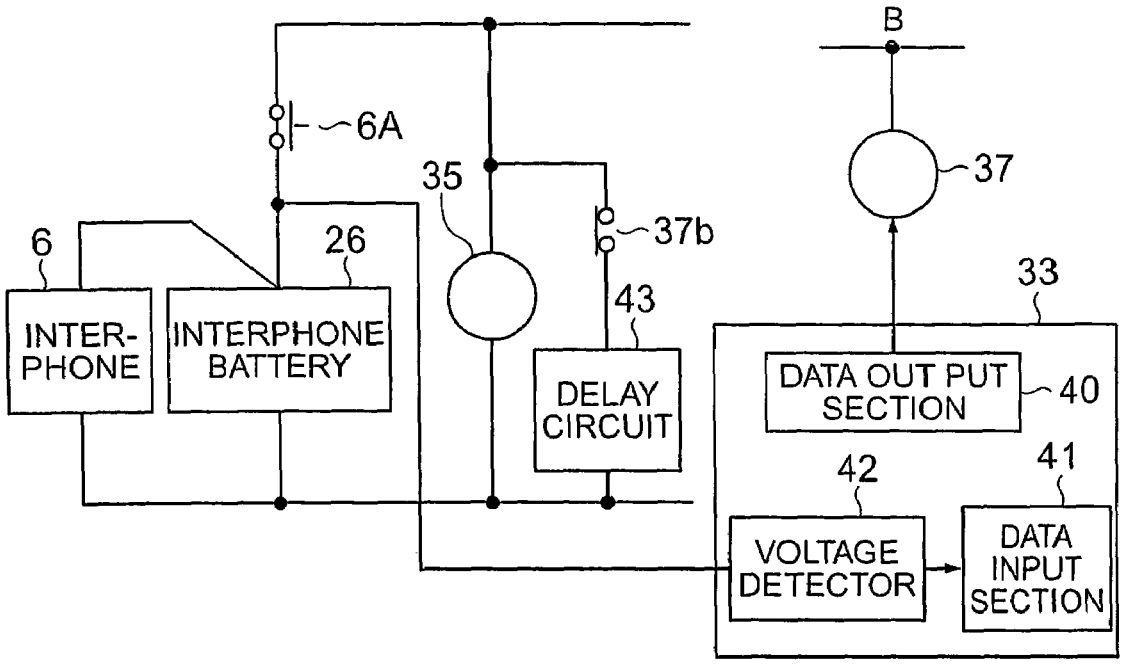
FIG. 8 is a block line diagram of an interphone power section in a remote monitor according to a third embodiment of this invention.

FIG. 8 is a block line diagram of the interphone power circuit 34 according to a third embodiment. The interphone power circuit 34 comprises a voltage detector 42 which here monitors the output voltage value of the interphone battery 26. The monitored result is transmitted via a data input section 41 to the CPU 14. The voltage detector 42 detects whether the output voltage value of the interphone battery 26 is greater than a predetermined value, and can be comprised of a commercially available voltage-detecting IC.

Figure 9:
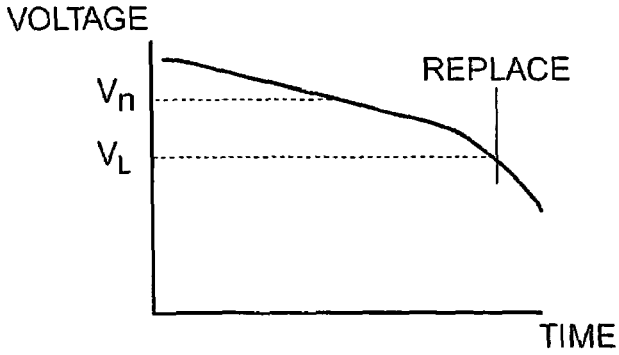
FIG. 9 is a diagram showing discharge characteristics of a battery in the remote monitor of FIG. 8 as voltage-time characteristics.

FIG. 9 is a line diagram showing discharge characteristics of the interphone battery 26 of FIG. 8 as voltage-time characteristics. When fully charged, the interphone battery 26 normally has a slightly higher voltage than the voltage rating Vn. However, as the current is discharged and the battery is depleted, the voltage decreases over time, and, when the voltage has fallen to the lifespan voltage, the battery is replaced.

When the voltage rating is DC 1.2V (per battery), the lifespan voltage is normally approximately 1.0 V. When the interphone battery 26 has decreased to a correspondingly low voltage, the auxiliary power 29 (battery 29A) is not disconnected.

According to this embodiment, power can be continuously supplied without cutting off the auxiliary power while allowing the battery for the interphone, used in emergencies, to be replaced; this ensures the safety of passengers.

Embodiment 4

Figure 10:
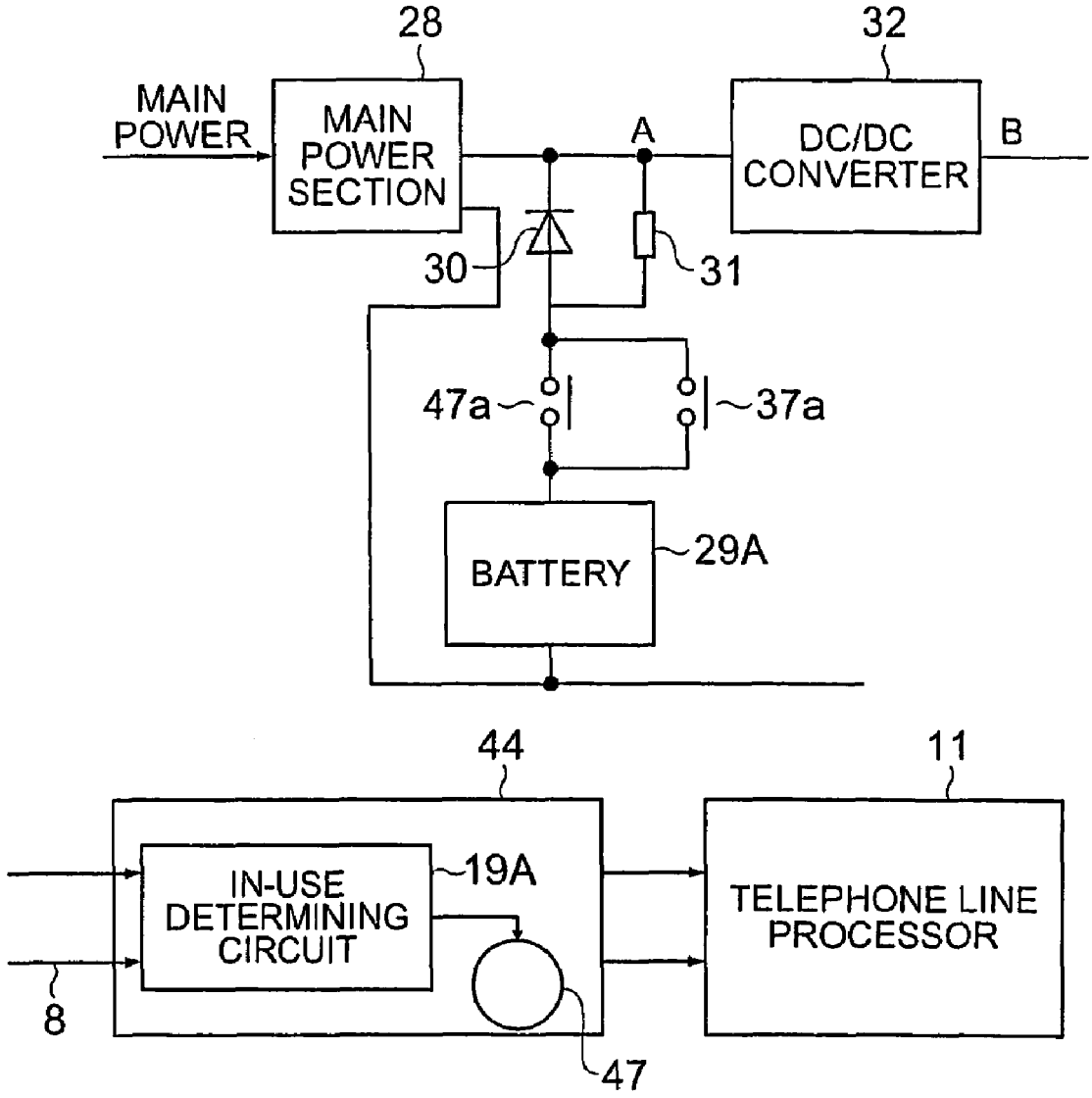
FIG. 10 is a block line diagram of an interphone power section in a remote monitor according to a fourth embodiment of this invention.

FIG. 10 is a block line diagram of an interphone power circuit according to a fourth embodiment. FIG. 10 chiefly shows the circuit sections corresponding to FIG. 2. A telephone line incoming-call detector 44 has an in-use determining circuit 19A; the telephone line incoming-call detector 44 detects a call by telephone and, after connecting to the public telephone line network 8, connects to the telephone line processor 11.

A feature of this embodiment is that the telephone line incoming-call detector 44 operates using power supplied by the public telephone line network 8 in the same way as a conventional telephone. Since a conventional telephone operates using power of DC 48V supplied by the public telephone line network 8, the constitution of the device itself requires no operating power. This amount of power is sufficient for a small-scale circuit, but a high-consumption element such as the CPU 14 requires another source of power.

The telephone line incoming-call detector 44 has the same circuit constitution as the telephone line processor 11, and activates a electromagnetic relay 47 by detecting a call from the public telephone line network 8. The telephone line incoming-call detector 44 can be realized by substituting the always-open contact 47*a* of the electromagnetic relay 47 for the contact 35*a* (thereby giving it the same functions as the emergency call button 6A) and connecting the contact 47*a* in parallel with the relay contact 37*a*.

Therefore, it is possible to provide a system which does not break down when there is a call from the monitoring center during a power failure.

Embodiment 5

Figure 11:
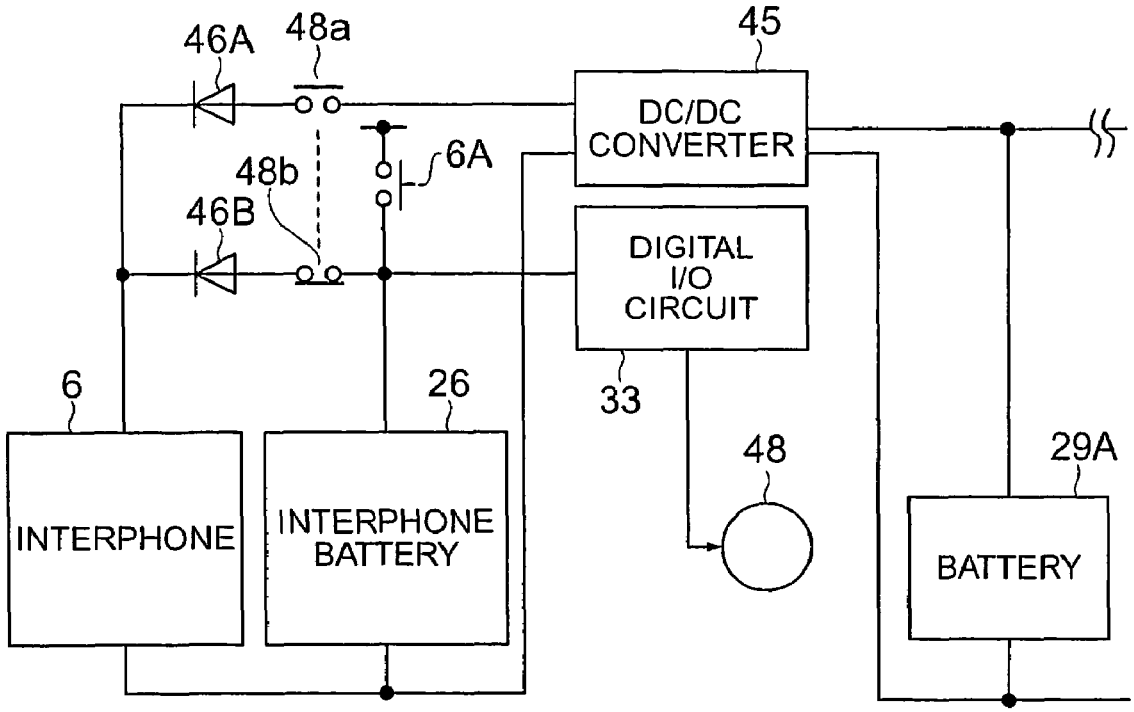
FIG. 11 is a block line diagram of an interphone power section in a remote monitor according to a fifth embodiment of this invention.

FIG. 11 is a block line diagram of an interphone power section according to a fifth embodiment of this invention. In this embodiment, an electromagnetic relay comprising a second switching unit is applied when the digital input/output circuit 33 has detected a drop in the voltage of the interphone battery 26, and, when the electromagnetic relay 48 is depleted (i.e. when the voltage of the interphone battery 26 is no longer decreasing), the interphone battery 26 supplies drive power to the interphone 6 via an always-closed contact 48*b* and a diode 46B. When the voltage of the interphone battery 26 has decreased, drive power is supplied from the battery 29A to the interphone 6 via a DC/DC converter 45, an always-open contact 48*a* of the electromagnetic relay 48, and a diode 46A.

As a result, even when the interphone battery 26 has insufficient capacity, the interphone 6 can be operated by power from the battery 29A.

This embodiment newly provides the DC/DC converter 45, but this may be omitted in the case where the voltage value of the battery 29A is the same as that of the interphone battery 26. The battery 29A normally has a voltage of DC 7.2V, and the interphone battery 26 has a voltage of DC 6V. At these levels, along with the decreasing voltage of the diode 46A, both may be treated as approximately equal voltages.

The drive current of the interphone 6 is approximately 20 mA; since this is little more than approximately 4% of the current consumed by the overall remote monitor 2 (approximately 500 mA), the any depletion of the battery 29A caused by driving the interphone 6 may be more or less ignored. Therefore, no special concern need be given to deterioration in the performance of the battery 29A.

Embodiment 6

Figure 12:
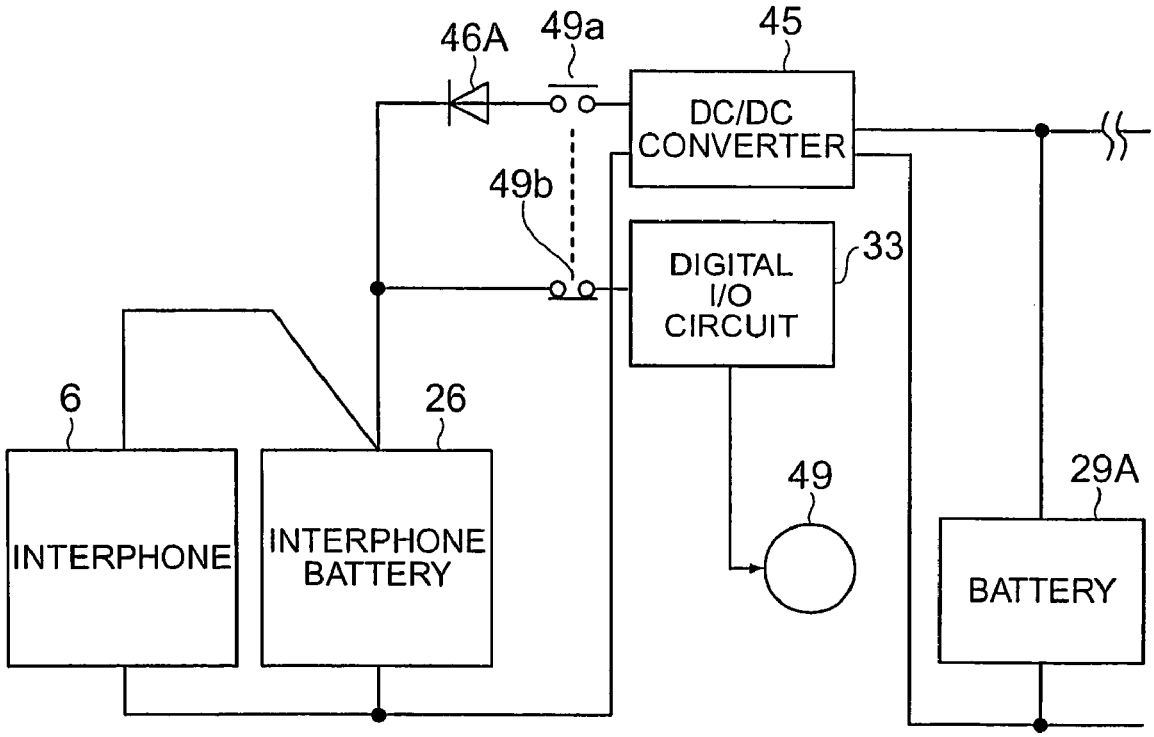
FIG. 12 is a block line diagram of an interphone power section in a remote monitor according to a sixth embodiment of this invention.

FIG. 12 is a block line diagram of an interphone power section according to a sixth embodiment of this invention. In this embodiment, a second switching unit comprises an electromagnetic relay 49, applied when the digital input/output circuit 33 has detected a drop in the voltage of the interphone battery 26.

When the electromagnetic relay 49 is depleted (i.e. when the voltage of the interphone battery 26 is not decreasing), the interphone battery 26 supplies power to the interphone 6, and, when the voltage of the interphone battery 26 decreases and the electromagnetic relay 49 has been applied, drive power is supplied from the battery 29A via the DC/DC converter 45, the always-open contact 49*a* of the electromagnetic relay 49, and the diode 46A to the interphone 6; in addition, the battery 29A charges the interphone battery 26.

As described above, since the interphone battery 26 has a lower capacitance than the battery 29A, almost no damage caused is caused when the interphone battery 26 is charged by the battery 29A, enabling the interphone 6 to continue operating and thereby ensuring the safety of the passengers.

Embodiment 7

According to a seventh embodiment, in the sixth embodiment shown in FIG. 12, when the auxiliary power 29 has been charged by the battery 29A to a voltage exceeding the predetermined value written in the EEROM 17, the electromagnetic relay 49 is switched OFF and the interphone 6 is driven by the original interphone battery 26.

In the fifth and sixth embodiments described above, the battery 29A continuously supplies a drive power voltage to the interphone 6, with a consequent danger that the remote monitor 2 may become incapable of operating after the interphone 6 has been used for a long period of time. The seventh embodiment eliminates this problem.

Embodiment 8

According to an eighth embodiment, in the circuit device of FIG. 8, with regard to step S4 in the flowchart of FIG. 7, the voltage detector 42 monitors the voltage of the interphone battery 26 and notification of the voltage is realized by using a push-button signal in compliance with an internal control of the telephone line processor 11 (FIG. 1).

Normally, communication between the interphone 6 and the monitoring center of the elevator maintenance company 9 is terminated by a push-button signal (e.g. by pressing a button such as "8") from the monitoring center.

When this termination signal has been received, assuming that a drop in the voltage of the interphone battery 26 has been detected, the staff at the monitoring center can be notified of the voltage drop of the interphone battery 26 by a push-button signal of, for example, "1", generated from the telephone line processor 11 in the remote monitor 2.

The push-button signal is an acoustic signal within the audible range, but has an advantage of being clearly different from the sound of a human voice, making it easily recognizable by the staff.

According to the invention disclosed in the first to eighth embodiments, during prolonged power failure, the remote monitor enables a request for assistance to be transmitted from the elevator carriage to the elevator maintenance company. Further, the reduced depletion of the auxiliary power enables it to be used over a long period of time, preventing its premature depletion without increasing its size.

Embodiment 9

Figure 13:
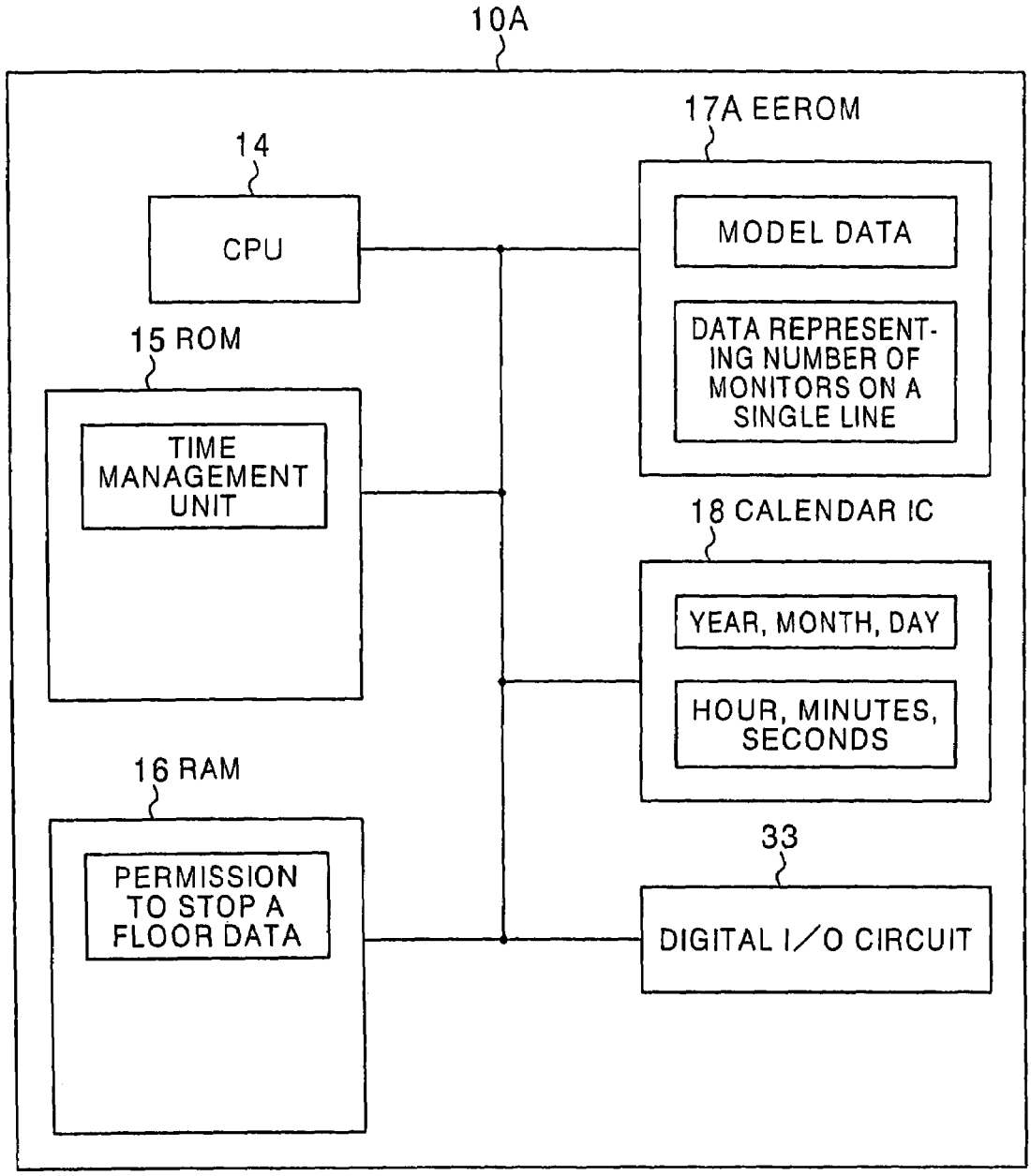
FIG. 13 is a block line diagram of a digital circuit section in the remote monitor for elevator according to a ninth embodiment.
Figure 25:
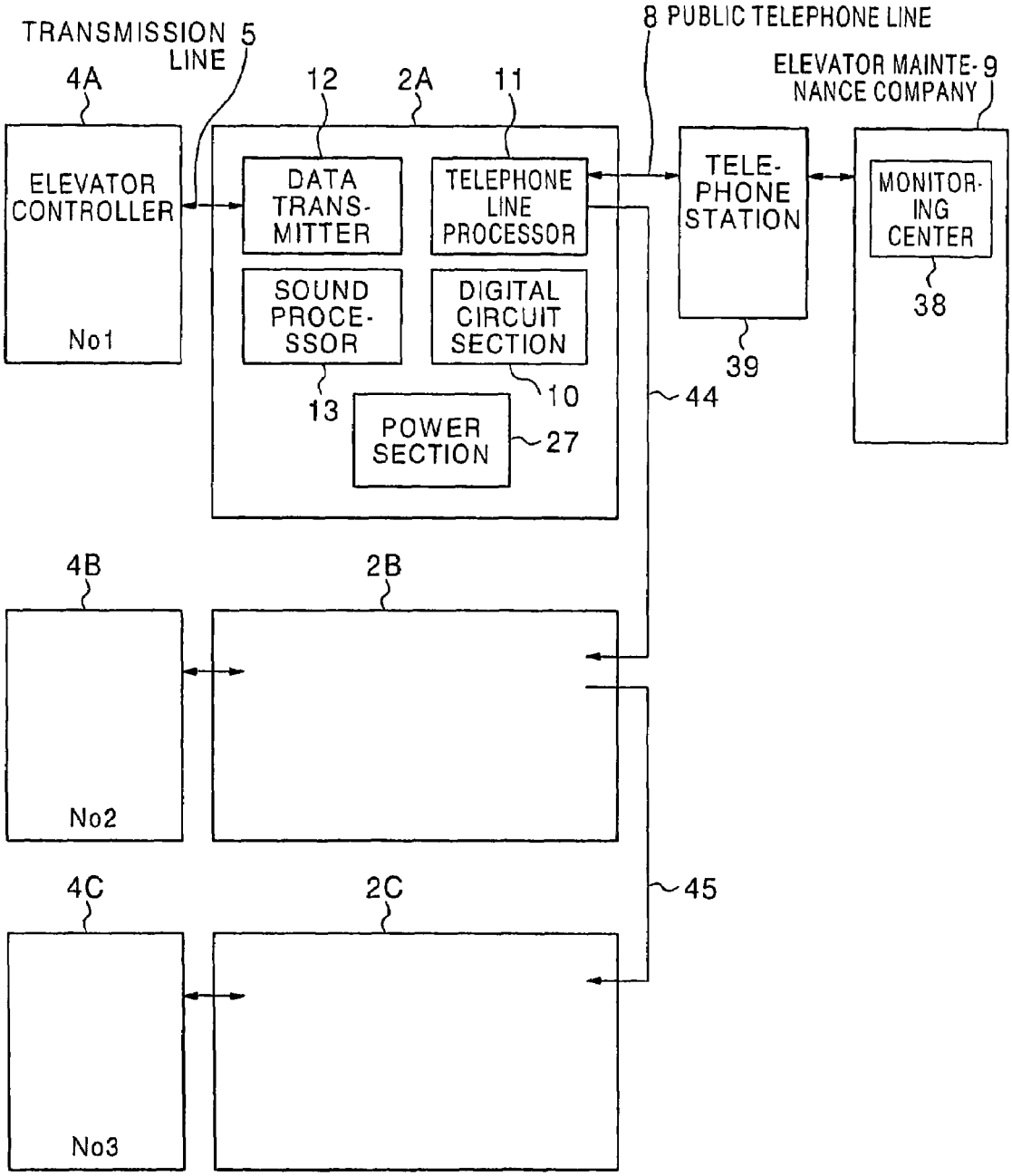
FIG. 25 is a block line diagram showing a conventional telephone circuit constitution shared by a plurality of remote monitors.

@FIG. 13 is a block line diagram of a digital circuit section according to a ninth embodiment. The system constitution is that of FIG. 25, and the remote monitor is that of FIG. 22.

Figure 22:
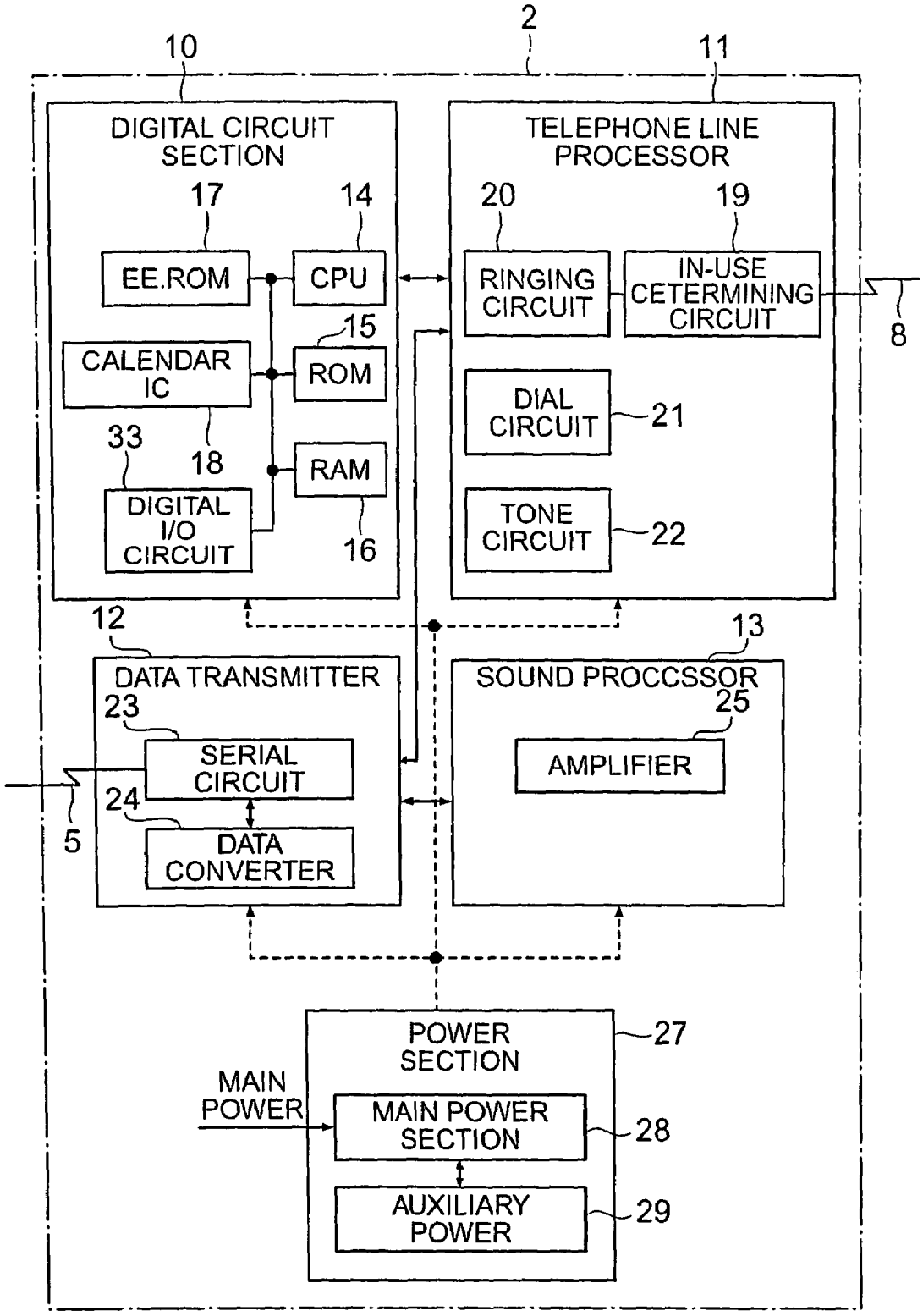
FIG. 22 is a block line diagram of a conventional remote monitor.
Figure 23:
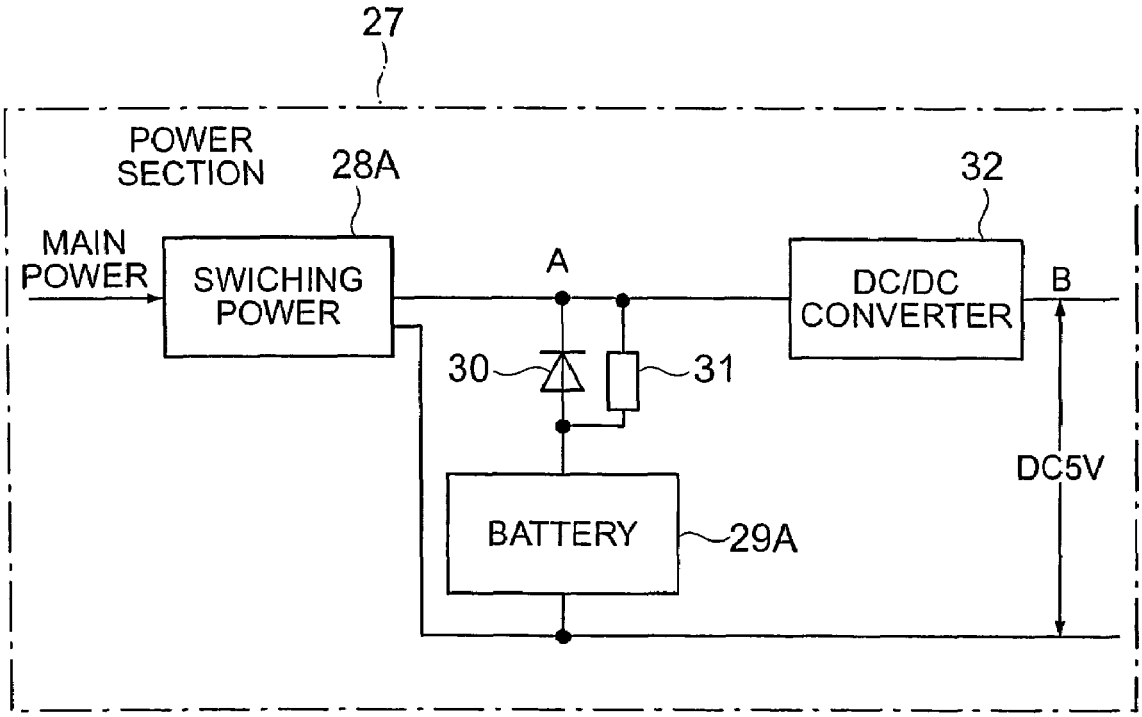
FIG. 23 is a block line diagram of a power section in a conventional remote monitor.
Figure 24:
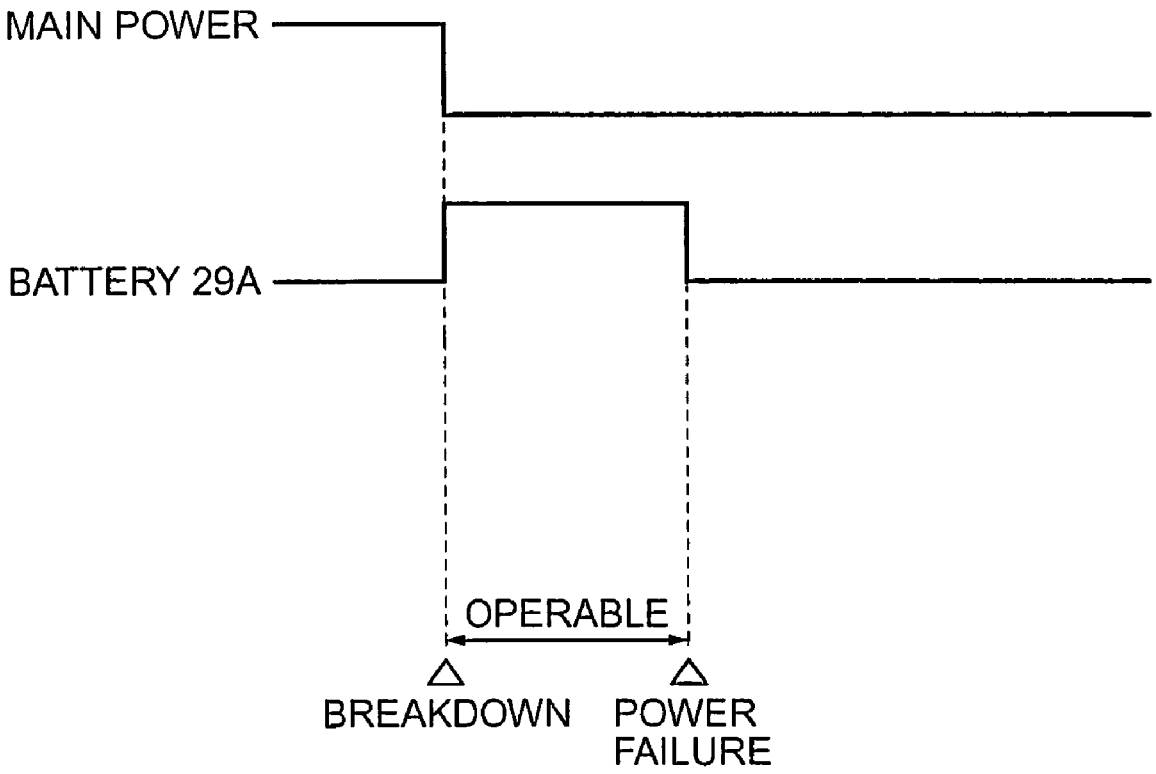
FIG. 24 is a timing chart illustrating the operation of a conventional remote monitor.

FIG. 13 shows the internal constitution of the digital circuit section 10A according to this invention, formed by extracting the digital circuit 10 from FIG. 22. Three elevators A, B, and C are installed in a single building, and elevator controllers 4A, 4B, and 4C are provided for each of the elevators A, B, and C.

Similarly, a remote monitor 2A is provided for the elevator controller 4A, a remote monitor 2B is provided for the elevator controller 4B, and a remote monitor 2C is provided for the elevator controller 4C; the remote monitors 2A, 2B, and 2C are connected to the elevator controllers 4A, 4B, and 4C via transmission lines 5.

It is a feature of the remote monitor 2A comprising the digital circuit section 10A that a call from the monitoring center 38 can be dealt with only during a specific response time, different response times being set for each elevator model.

In the digital circuit section 10A, two types of data (elevator model data and elevator number data for each line) are stored in the EEROM 17A. The elevator model data is set as follows: "00" for the remote monitor 2A, "01" for the remote monitor 2B, and "02" for the remote monitor 2C. The elevator number data for each line s set to correspond to the total number of elevators, in this case "03".

The remote monitors receive communications in during times allocated in one-minute units, based on the elevator model and elevator number data for each line. That is, the remote monitor 2A receives communications starting at 00 minutes on each hour, and thereafter at 03, 06, . . . 54, and 57 minutes past the hour. Similarly, the remote monitor 2B receives communications at 04, 07, . . . 55, and 58 minutes, and the remote monitor 2C, at 02, 05, 08, . . . 56, and 59. When the monitoring center 38 makes a call in correspondence with these times, the desired remote monitor 2 can be rapidly selected.

FIG. 14 is a flowchart illustrating the operation of the remote monitor 2A side in the ninth embodiment. In step S11, the sound of a call from the monitoring center 38 via the public telephone line network 8 is detected. The sound of this call is detected by the telephone line processor 11 (see FIG. 25) and read by the CPU 14, and, in normal circumstances, is immediately processed (by putting the public telephone line network 8 on hook, or, in the case of a telephone, by picking up the receiver).

In step S12, time data is read from a calendar IC 18. The calendar IC 18 stores time data comprising year, month, date, and time in hours, minutes, and seconds, but this embodiment uses only the minute data.

In step S13, each remote monitor confirms whether it can receive communications at the present time based on the data stored in the EEROM 17A. For example, when the present time is 00 minutes, the remote monitor 2A is capable of communicating, and consequently proceeds to step S14 and performs incoming call control. Similarly, when the present time is 01 minutes, the remote monitor 2B carries out communication processing.

Since there are three elevators in this embodiment, the operator of the monitoring center 38 can make a communication after waiting a maximum of two minutes to select the desired remote monitor 2. This makes it possible to reliably make a call in a short period of time without error, rather than making many telephone calls as in conventional devices.

Problems may be caused by discrepancies in the times of the calendar IC 18 of the remote monitor 2, but such problems can be more or less nullified by adjusting the times during routine inspections of the elevator.

Embodiment 10

Figure 15:
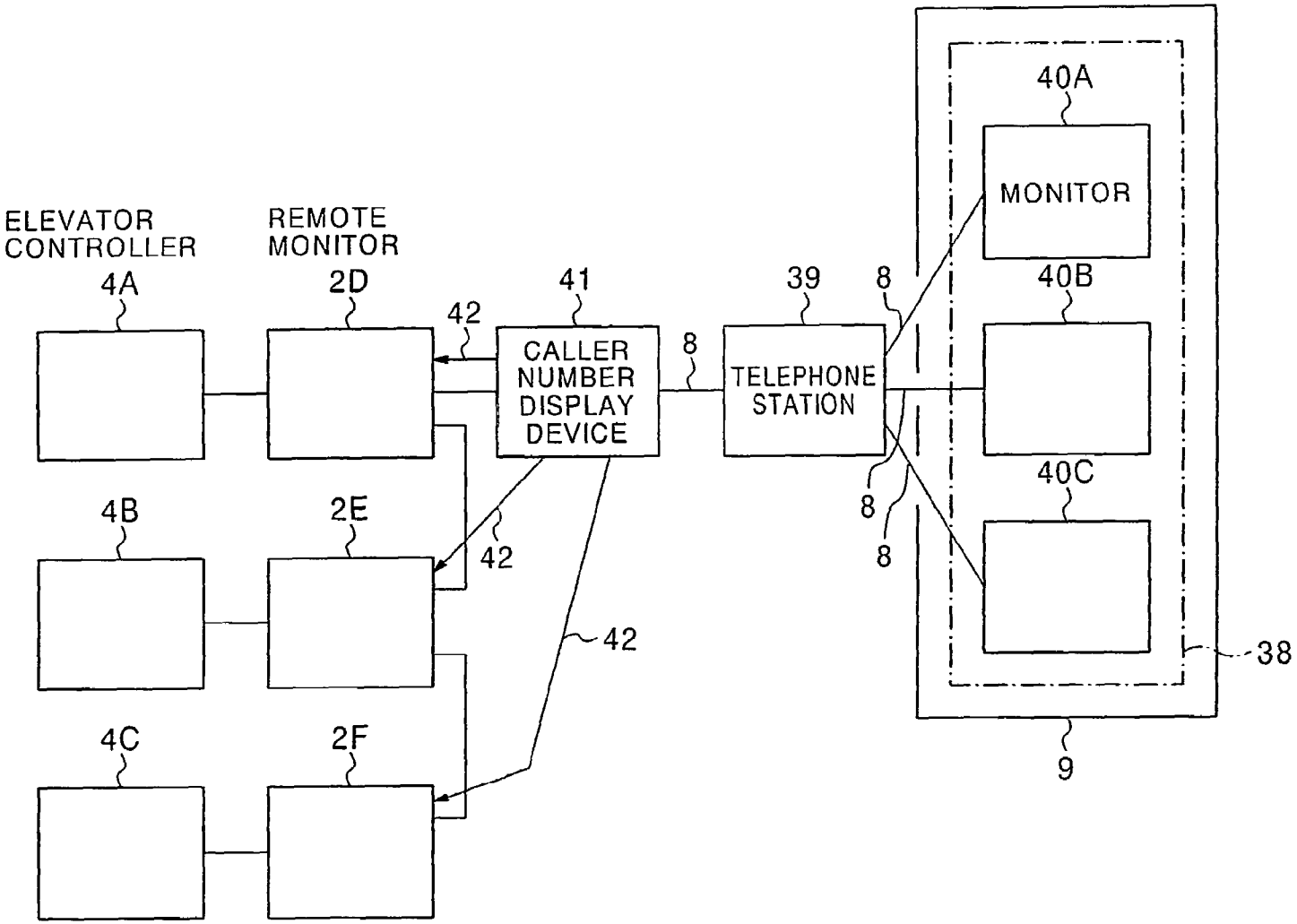
FIG. 15 is a block line diagram of a remote monitor for elevator according to a tenth embodiment.

FIG. 15 shows a tenth embodiment. A monitoring center 138 in a elevator maintenance company 9 has a plurality of monitors 140A, 140B, and 140C, corresponding to the number of elevators being maintained. Normally, considering the load of the public telephone line 8, one thousand five hundred remote monitors 2 are allocated to one monitor 140.

Different telephone numbers are allocated to the monitors 140A, 140B, and 140C. For example, the monitor 140A is allocated a number of 5555, the monitor 140B, a number of 5556, and the monitor 140C, a number of 5557. By allocating the telephone numbers in this way, while also making use of the caller number display function offered by the telephone company, it is possible to relay the wishes of the operator of the monitoring center 138 to the remote monitors 2. This will be explained below.

Unlike the conventional system, a caller number display device 141 is provided in the elevator machine chamber 1, and, after the device has been identified, the remote monitors 2D, 2E, and 2F are selected via number notification transmission lines 42 (normally controlled by RS232C or USB).

In this method, only the remote monitor 2D selectively responds to a call from the monitor 140A, only the remote monitor 2E selectively responds to a call from the monitor 140B, and only the remote monitor 2F selectively responds to a call from the monitor 140C.

Since the number of monitors per line when using a communal public telephone line 8 is normally four or fewer, the system constitution will be problem-free if there is a maximum of four monitors 140.

Thus the monitor. 40 of the monitoring center 38 can identify a desired monitor 2 even when a communal public telephone line 8 is used. As a result, the waiting time required in selecting a desired device in the first embodiment can be eliminated.

Embodiment 11

Figure 16:
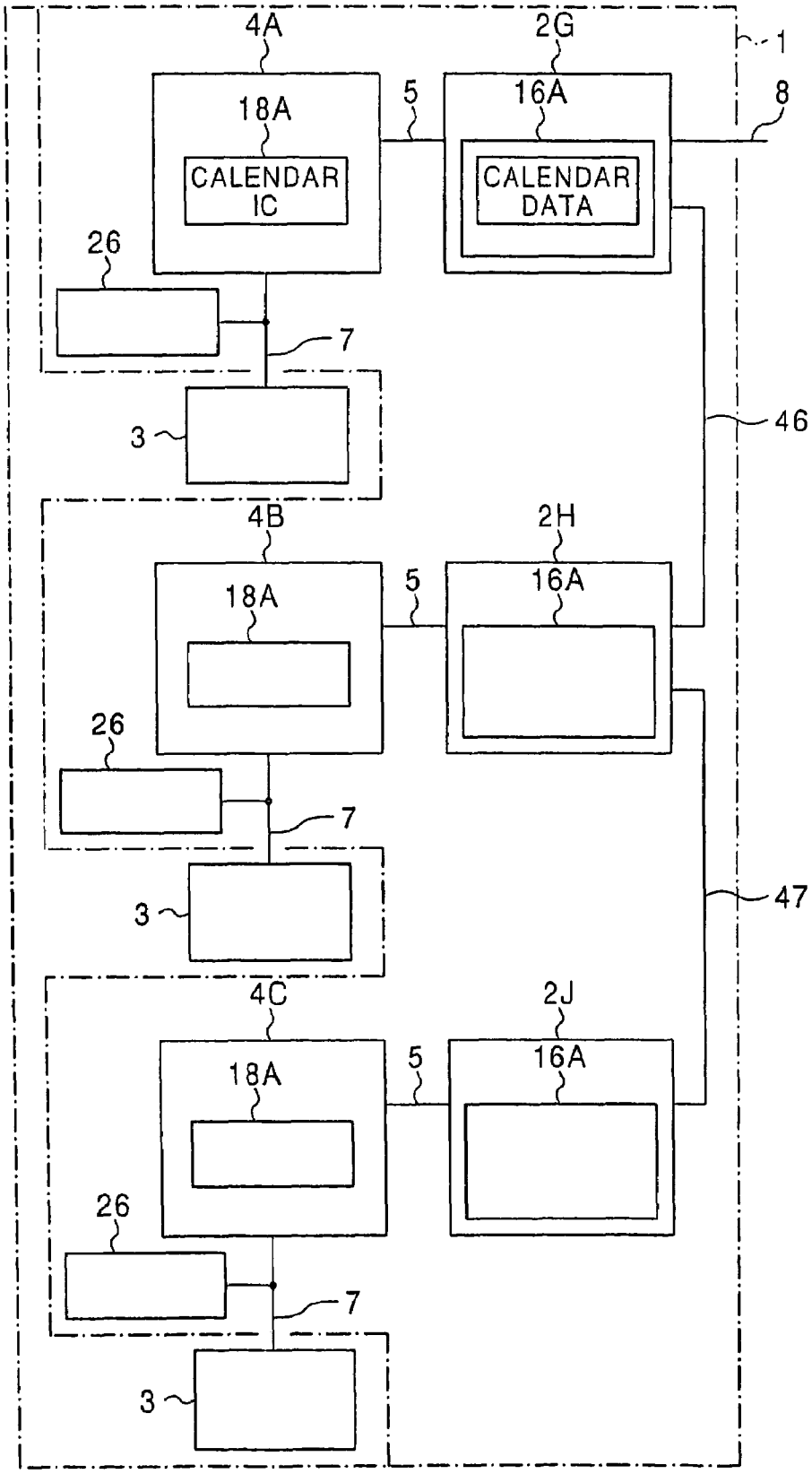
FIG. 16 is a block line diagram of a remote monitor for elevator according to an eleventh embodiment.

FIG. 16 shows a remote monitoring system according to an eleventh embodiment.

Since the ninth embodiment uses data of the calendar IC 18 in the remote monitors 2, there is a danger of mistaken operation when the remote monitors 2 are storing different time data. To prevent this, the time data are transmitted as calendar data from the calendar IC 18A of the elevator controller 4 via the transmission lines 5 to a RAM 116A, provided in a digital circuit section of the remote monitor 2G, and also via lines 46 and 47 to other remote monitors 2H and 2J.

In this communications system, time data is appended to the remote monitor using the transmission lines 5, and time data of the elevator controller 4 is captured in the remote monitor 2.

This arrangement prevents operating mistakes caused when the remote monitors 2 store different time data.

Embodiment 12

Figure 17:
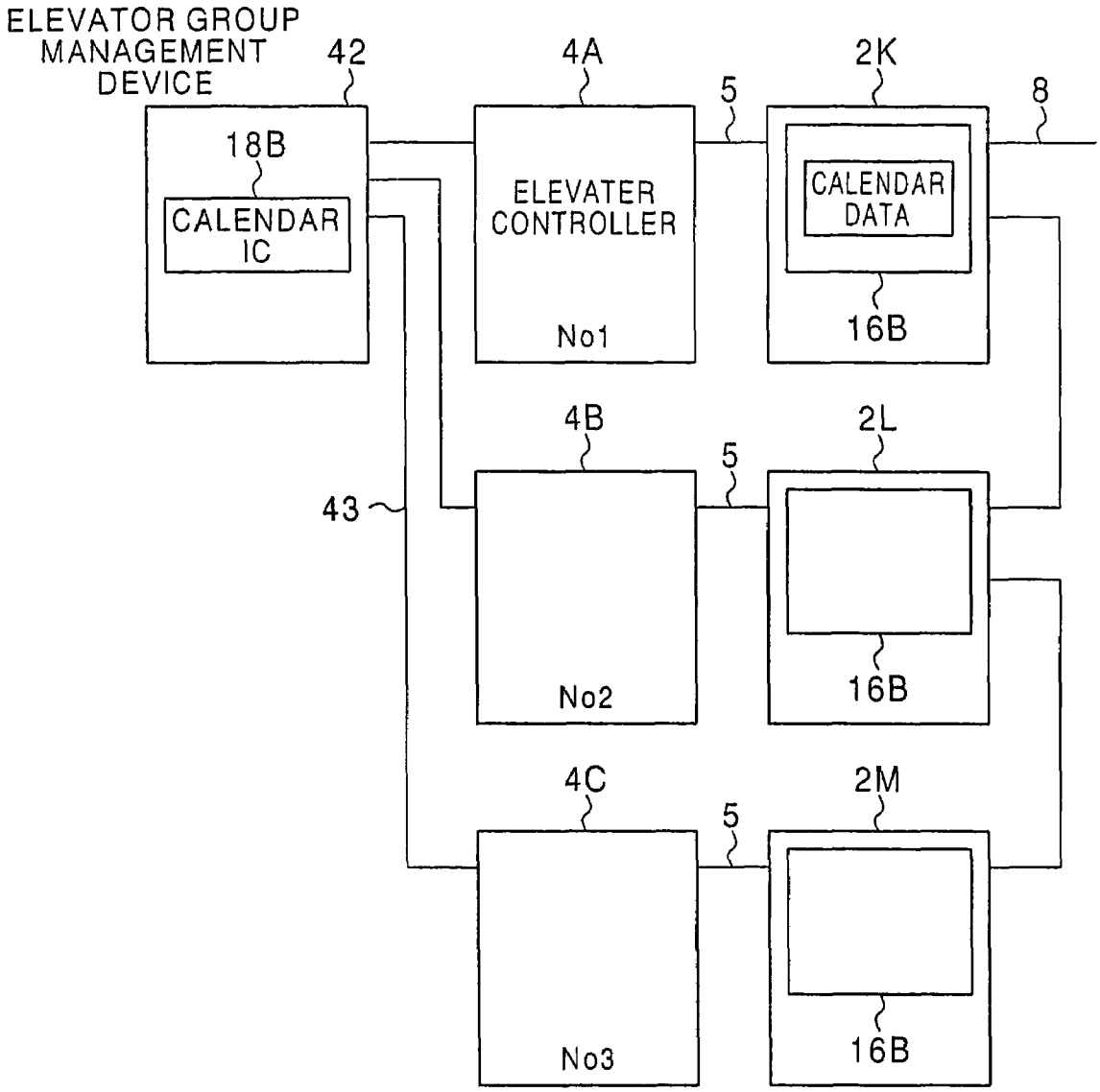
FIG. 17 is a block line diagram of a remote monitor for elevator according to a twelfth embodiment.

FIG. 17 shows a remote monitoring system according to a twelfth embodiment.

The twelfth embodiment utilizes the fact that elevators are normally managed in groups in cases where a public telephone line 8 is required. Elevator group management is implemented to effectively manage a plurality of elevators. An elevator group management device 42 has the same circuit constitution as the elevator controller 4, and further comprises a calendar IC 18B. The number notification transmission line 42 connects to elevator controllers 4A, 4B, and 4C, via group management transmission lines 43. Each of the remote monitors 2K, 2L, and 2M in the elevator controllers comprises a RAM 116B which stores calendar data.

The time data are transmitted in the same way as in the eleventh embodiment, and are captured from the calendar IC 18B of the number notification transmission line 42 in the elevator controllers 4A, 4B, and 4C, via the group management transmission lines 43; thereafter, the time data are transmitted by the same method as that in the third embodiment. Ethernet is usually used as the transmission line 43.

Since the ninth embodiment uses data of the calendar IC 18 in the remote monitor 2, there is a danger of mistaken operation when the remote monitors 2 are storing different time data. In this embodiment, this is prevented by transmitting the time data from the number notification transmission line 42 to calendar data registers in the RAM 116B of the remote monitors 2.

The twelfth embodiment differs from the eleventh embodiment in that the time data are collected in the number notification transmission line 42, reducing time differences.

Embodiment 13

Figure 18:
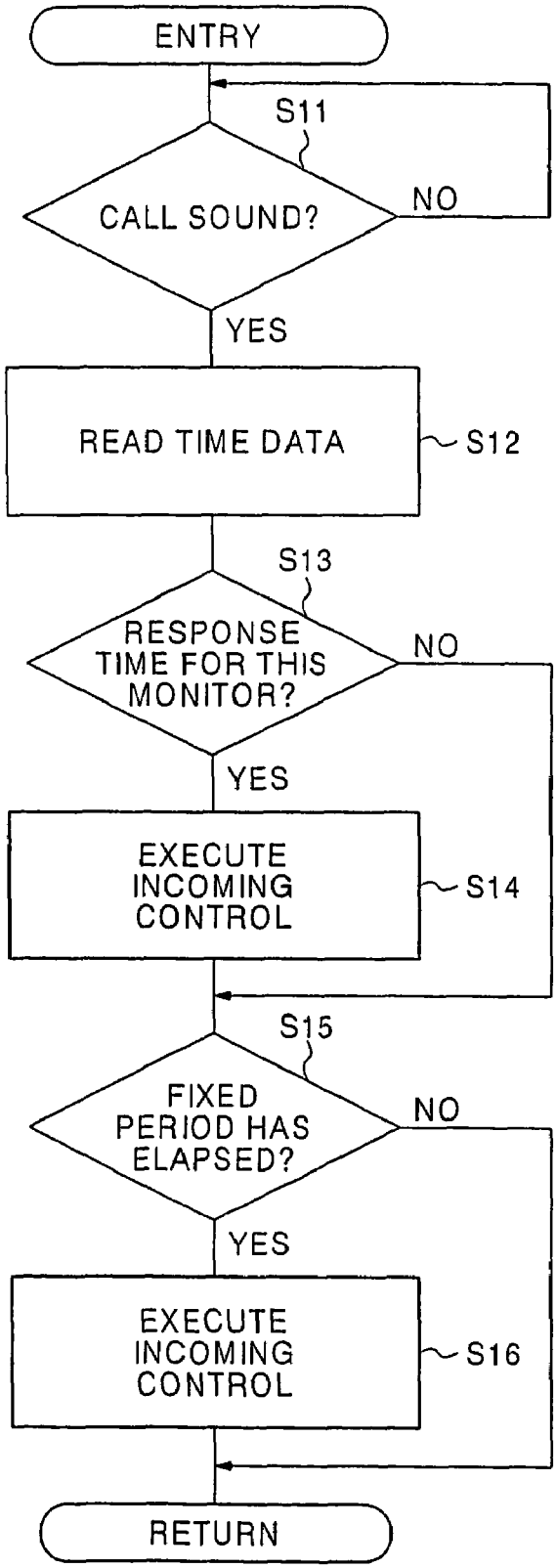
FIG. 18 is a flowchart illustrating a thirteenth embodiment.

FIG. 18 is a flowchart according to a thirteenth embodiment.

The flowchart of FIG. 18 adds steps S15 and S16 to the steps S11 to S14 of the ninth embodiment shown in FIG. 14. In the digital circuit 10, time data for counting timeout is appended in the EEROM 17A having the constitution of FIG. 13.

The time data has a slightly different value for each of the remote monitors 2 in one line. For example, the time data of the remote monitors 2A, 2B, and 2C have values of 30 seconds, 40 seconds, and 50 seconds respectively. These times avoid simultaneous incoming communications when there is a plurality of elevators.

In step S15, a check is made to determine whether an incoming control has been performed within a fixed time period, set beforehand as described above, and, when the fixed time elapses without an incoming control being performed, the operation shifts to step S16 to enforce an incoming control.

The thirteenth embodiment provides a solution to the problem of discrepancies in the time data of the plurality of remote monitors 2, which is a drawback of the ninth embodiment.

Embodiment 14

Figure 19:
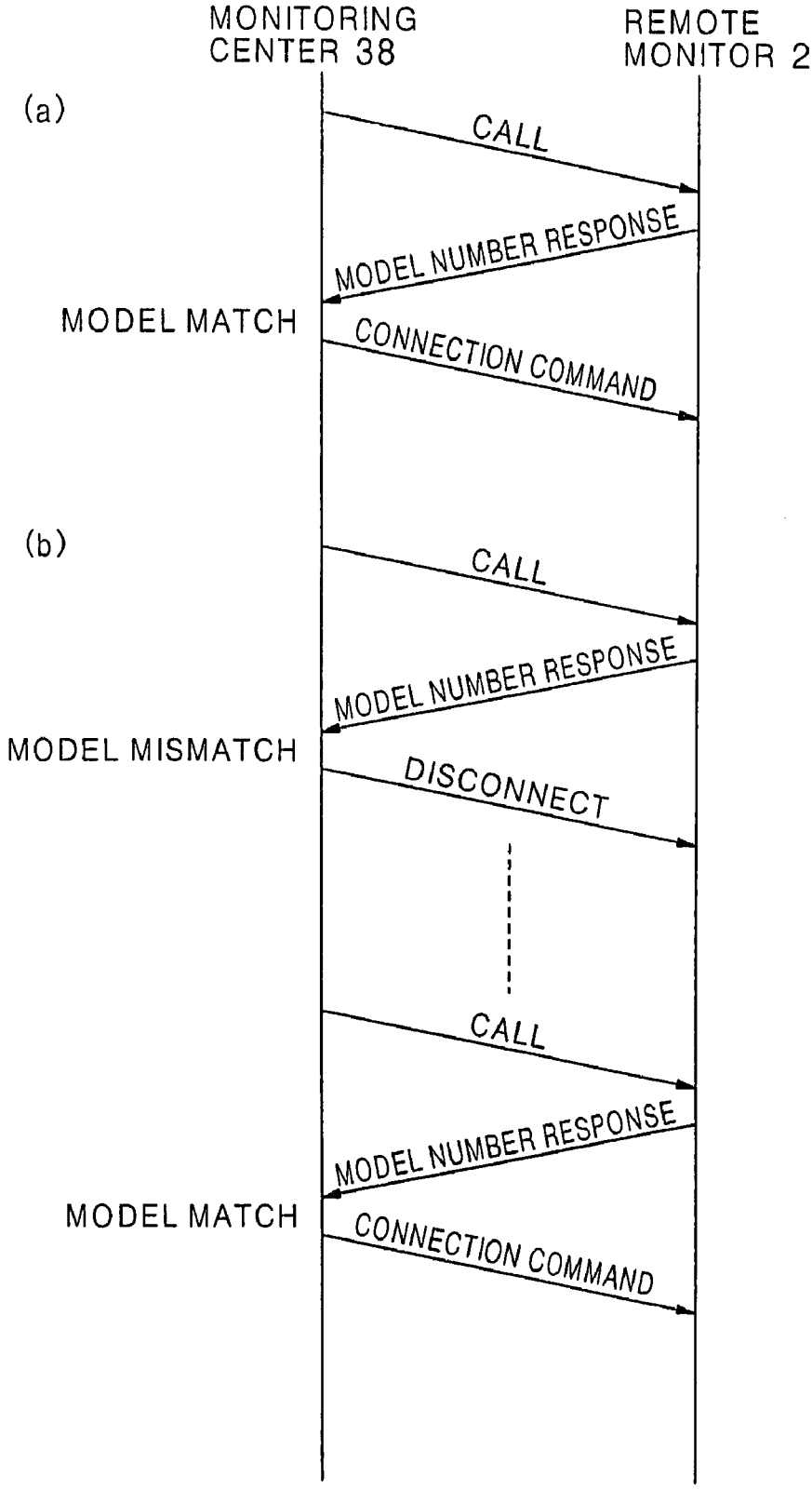
FIG. 19 is a data transition diagram according to a fourteenth embodiment.

FIG. 19 is a data transition diagram illustrating a fourteenth embodiment. The fourteenth embodiment solves a problem of the ninth embodiment, wherein a remote monitor 2 which receives an incoming communication does not know which elevator is transmitting the call.

In response to a call from the monitoring center 138, the remote monitor 2 transmits data representing its own model number by using a push-button signal. For example, when the model data in the EEROM 17A (FIG. 13) is 01, a push-button signal of "1" is output from the telephone line processor 11 (FIG. 22) to the public telephone line network 8; when the model data is 02, a push-button signal of "2" is output, and when the model data is 03, a push-button signal of "3" is output.

At the monitoring center 138, an operator or an automatic incoming communication device determines whether the elevator corresponds to that requested by the push-button signal, and, when the elevator corresponds, transmission processing is performed as in (a) of FIG. 19. This enables the monitoring center 138 to confirm the requested monitor.

When the monitoring center 138 determines that the elevator does not match the signal, the operation at (b) is performed and the public telephone line network 8 is cut off (disconnected). Thereafter, in the first embodiment, a call is placed again after a predetermined time has elapsed.

As a result, the monitoring center 138 can not only confirm the desired elevator, but can identify an incorrect incoming elevator model number caused by time differences at the remote monitor 2.

Embodiment 15

Figure 20:
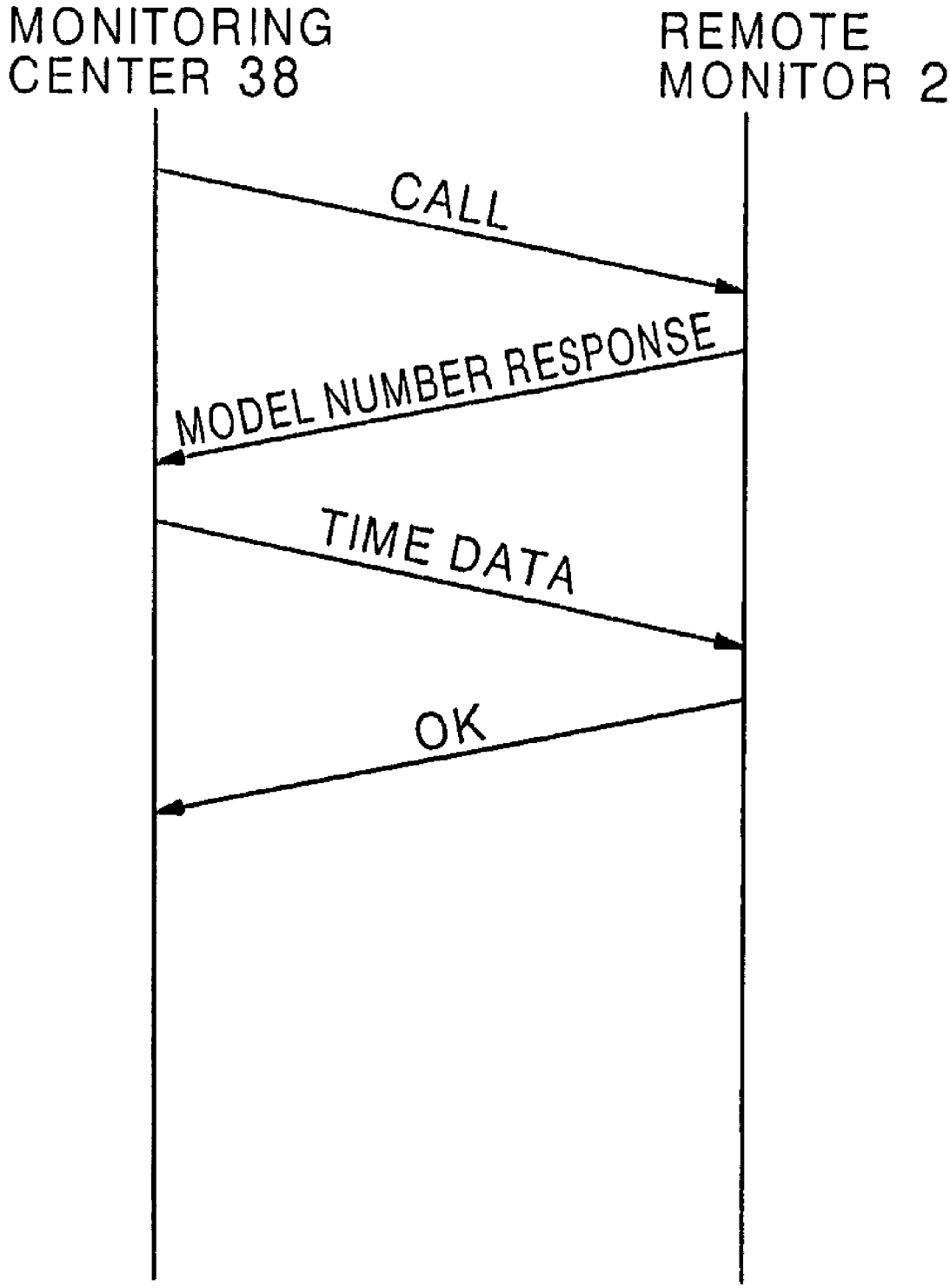
FIG. 20 is a data transition diagram illustrating data transition according to a fifteenth embodiment.
Figure 21:
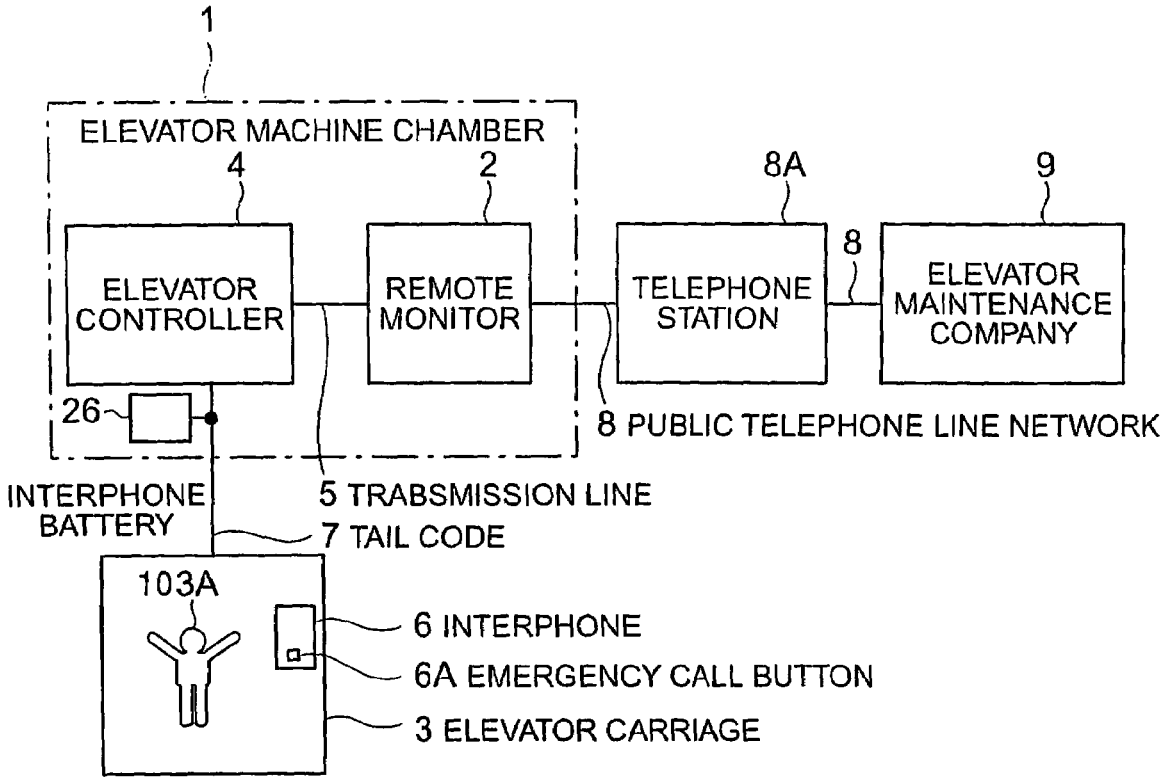
FIG. 21 is a block line diagram of a conventional remote monitoring system.

FIG. 20 is a data transition diagram illustrating a fifteenth embodiment. The fifteenth embodiment uses remote control to simply correct problems caused by time differences at the remote monitor 2 which has received an incoming communication in the ninth embodiment.

Since discrepancies in time data are often in units of seconds, the CPU 14 of the remote monitor 2 corrects second data in the calendar IC 18 by using a push-button signal (e.g. "#") for second-alignment from the monitoring center 138.

In another arrangement of the fifteenth embodiment, since the monthly time difference (error occurring over one month) of the calendar IC 18 is generally approximately fifteen seconds, correction in units of seconds avoids breakdown, but time differences can be more precisely corrected by transmitting time data from the monitoring center 38.

According to the invention of the ninth to fifteenth embodiments, when a plurality of remote monitors are sharing a public telephone line, it is possible to provide an inexpensive remote monitoring system which allows telephone communications from the monitoring center to be connected easily to a desired model by means of time management by the monitoring center.

Furthermore, the remote monitors comprise a unit for detecting and displaying the caller telephone number from the monitoring center, and the displayed caller telephone number from the monitoring center is determined before performing incoming control, thereby making it possible to provide an inexpensive remote monitoring system which enables the monitoring center to easily connect, and transmit telephone communications, to the desired model.

Modifications

To visually simplify the embodiments described above, electromagnetic relays which open and close mechanically are used as the open/close units and switching units, but a semiconductor switch such as, for example, a photo-MOS relay using a noncontact switching element such as a MOSFET, may be used instead.

In the above embodiments, the elevators are maintained by an elevator maintenance company, but this should be interpreted in a broad sense so as to include any public agency or private organization with the ability to carry out predetermined maintenance duties.

What is claimed is:

1. A remote monitor for elevator comprising:

an auxiliary power which supplies operating power instead of a main power when the main power fails;

an interphone battery for an interphone, provided in an elevator carriage;

a transmitting unit which monitors the running state of the elevator and transmits the running state to a monitoring center of an elevator maintenance agency via a public telephone line network;

a communication unit which allows communication between said interphone and said monitoring center by switching ON an emergency call button, provided in said elevator carriage;

a first switching unit which cuts off said auxiliary power when there has been no irregularity in the monitoring information of the elevator after the operating power has been supplied for a fixed period of time from said auxiliary power instead of said main power when said main power fails; and a second switching unit which is driven by power from said interphone battery, and re-injects said auxiliary power when said emergency call button has been pressed.

2. The remote monitor for elevator as described in claim 1, further comprising a delay circuit which, when said emergency call button has been pressed, continues to drive said second switching unit after the emergency call button has been turned OFF for a period of time corresponding to the period of time during which it was ON.

3. The remote monitor for elevator as described in claim 1, further comprising a voltage monitoring unit which monitors the voltage of said interphone battery, and, when a drop in the voltage of said interphone battery below a predetermined value has been detected, terminates the cut-off of said auxiliary power even in the case where a fixed period of time has elapsed since power failure with no irregularity in the monitored information of the elevator.

4. The remote monitor for elevator as described in claim 3, further comprising a notifying unit which, when said voltage monitoring unit has detected that the voltage of said interphone battery has dropped below a predetermined value, notifies said monitoring center of the voltage insufficiency of said interphone battery from said interphone side by using a push-button signal, after the communication between said interphone and said monitoring center has ended.

5. The remote monitor for elevator as described in claim 3, wherein, when said voltage monitoring unit has detected that the voltage of said interphone battery has dropped below a predetermined value, said monitoring center is notified of the voltage drop by a push-button signal from said interphone, transmitted via a telephone line processor.

6. The remote monitor for elevator as described in claim 2, further comprising a voltage monitoring unit which monitors the voltage of said interphone battery, and, when a drop in the voltage of said interphone battery below a predetermined value has been detected, terminates the cut-off of said auxiliary power even in the case where a fixed period of time has elapsed since power failure with no irregularity in the monitored information of the elevator.

7. The remote monitor for elevator as described in claim 6, further comprising a notifying unit which, when said voltage monitoring unit has detected that the voltage of said interphone battery has dropped below a predetermined value, notifies said monitoring center of the voltage insufficiency of said interphone battery from said interphone side by using a push-button signal, after the communication between said interphone and said monitoring center has ended.

8. The remote monitor for elevator as described in claim 6, wherein, when said voltage monitoring unit has detected that the voltage of said interphone battery has dropped below a predetermined value, said monitoring center is notified of the voltage drop by a push-button signal from said interphone, transmitted via a telephone line processor.

9. A remote monitor for elevator comprising:

an auxiliary power which supplies operating power instead of a main power when the main power fails;

an interphone battery for an interphone, provided in an elevator carriage;

a transmitting unit which monitors the running state of the elevator and transmits the running state to a monitoring center of an elevator maintenance agency via a public telephone line network;

a communication unit which allows communication between said interphone and said monitoring center by switching ON an emergency call button, provided in said elevator carriage;

a first switching unit which cuts off said auxiliary power when there has been no irregularity in the monitoring information of the elevator after the operating power has been supplied for a fixed period of time from said auxiliary battery instead of said main power when said main power fails; and a second switching unit which switches the operating power of said interphone from said interphone battery to said auxiliary power when a voltage drop of said interphone battery has been detected.

10. The remote monitor for elevator as described in claim 9, wherein, when a voltage drop of said interphone battery has been detected, said second switching unit switches the operating power of said interphone from said interphone battery to said auxiliary power, and charges said interphone batter by using said auxiliary power.

11. The remote monitor for elevator as described in claim 10, wherein, when the voltage value of said interphone battery being charged by said auxiliary power has exceeded a predetermined value, said second switching unit switches the operating power of said interphone from said auxiliary power back to said interphone battery.

12. A remote monitoring system for elevator having a plurality of remote monitors for individually monitoring the running states of a plurality of elevators installed in a building, the remote monitoring system transmitting running state data from said remote monitoring system via a communal public telephone line to a communal monitoring center, and allowing communication between interphones, provided in the carriages of the elevators, and said monitoring center via said public telephone line, wherein each of said plurality of remote monitors comprises a memory unit which stores incoming time data of different incoming times, the remote monitor performing incoming controls after independently determining call signals from said monitoring center, based on the incoming time data stored in said memory unit.

13. The remote monitoring system as described in claim 12, wherein time data of a specific elevator controller which controls a specific elevator is set as reference time data, and the remote monitors receive transmission of said reference time data, and use it as their own time data.

14. The remote monitoring system as described in claim 12, further comprising an elevator group managing device which group-manages a plurality of elevators, the remote monitors receiving transmission of time data from said elevator group managing device and using it as their own time data.

15. The remote monitoring system as described in claim 12, wherein, when there have been no incoming responses from any of the remote monitors after a fixed period of time has elapsed since a call signal was transmitted from said monitoring center, a specific remote monitor has priority in receiving incoming transmission.

16. The remote monitoring system as described in claim 12, wherein a remote monitor which has received a call signal from said monitoring center transmits its own model number to said monitoring center by using a push-button signal.

17. The remote monitoring system as described in claim 12, wherein said remote monitors correct the content of their own time management data by using a push-button signal from said monitoring center.

18. A remote monitoring system for elevator having a plurality of remote monitors for individually monitoring the running states of a plurality of elevators installed in a building, the remote monitoring system transmitting running state data from said remote monitoring system via a communal public telephone line to a communal monitoring center, and allowing communication between interphones, provided in the carriages of the elevators, and said monitoring center via said public telephone line, wherein each of said remote monitors comprises a caller number display unit which detects and displays a caller telephone number from said monitoring center, a different telephone number being set for each of a plurality of monitors provided in said monitoring center, and a monitor which can call a specific remote monitor being allocated beforehand, thereby enabling the remote monitors to perform incoming control after determin ing the caller telephone number displayed in said caller number display unit.

19. The remote monitoring system as described in claim 18, wherein, when there have been no incoming responses from any of the remote monitors after a fixed period of time has elapsed since a call signal was transmitted from said monitoring center, a specific remote monitor has priority in receiving incoming transmission.

20. The remote monitoring system as described in claim 18, wherein a remote monitor which has received a call signal from said monitoring center transmits its own model number to said monitoring center by using a push-button signal.

21. The remote monitoring system as described in claim 18, wherein said remote monitors correct the content of their own time management data by using a push-button signal from said monitoring center.

* * * * *